US010870308B2

(12) United States Patent
Bantle et al.

(10) Patent No.: US 10,870,308 B2
(45) Date of Patent: Dec. 22, 2020

(54) ADJUSTABLE FRAMES FOR USE WITH HANGING FOLDERS AND RELATED METHODS

(71) Applicant: LSC COMMUNICATIONS US, LLC, Chicago, IL (US)

(72) Inventors: Stephen Joseph Bantle, Edwardsville, IL (US); Su Chew Lee, Punggol (SG)

(73) Assignee: LSC COMMUNICATIONS US, LLC, Chicago, IL (US)

( * ) Notice: Subject to any disclaimer, the term of this patent is extended or adjusted under 35 U.S.C. 154(b) by 0 days.

(21) Appl. No.: 15/810,915

(22) Filed: Nov. 13, 2017

(65) Prior Publication Data

US 2019/0143738 A1 May 16, 2019

(51) Int. Cl.

| | |
|---|---|
| ***B42F 15/00*** | (2006.01) |
| ***B42F 17/12*** | (2006.01) |
| ***A47B 63/02*** | (2006.01) |
| ***A47F 7/14*** | (2006.01) |
| *A47B 45/00* | (2006.01) |

(52) U.S. Cl.

CPC ..... *B42F 15/0094* (2013.01); *A47B 63/02* (2013.01); *A47F 7/143* (2013.01); *B42F 17/12* (2013.01); *A47B 45/00* (2013.01)

(58) Field of Classification Search

CPC .... B42F 15/0094; B42F 15/007; B42F 17/12; B42F 15/0035; B42F 17/08; B42F 21/025; B42F 7/08; A47F 7/143; A47B 63/02; A47B 45/00; A47B 96/06; A47B 88/969; A47B 88/90; A47B 63/00; A47B 88/931

USPC ..... 312/184, 330.1, 183, 348.3, 348.5; 211/189, 162, 175, 184, 182, 45, 204, 211/206, 10, 126.13, 126.15, 194; 248/230.7, 231.81, 317

See application file for complete search history.

(56) References Cited

U.S. PATENT DOCUMENTS 2,226,763 A * 12/1940 Geib ..... A63H 33/06 211/194
2,336,802 A * 12/1943 Posner ..... B42F 15/0094 211/162
2,852,028 A * 9/1958 Patterson ..... B42F 15/0094 211/162
3,098,488 A * 7/1963 Schnelie ..... B42F 15/0094 211/126.13
3,944,080 A * 3/1976 Hansen ..... B42F 15/0094 211/46
3,955,511 A * 5/1976 Bak ..... A47B 45/00 108/137
3,999,663 A 12/1976 Walter et al.
4,030,610 A * 6/1977 Alexander ..... B42F 15/0094 211/182

(Continued)

*Primary Examiner* — Hiwot E Tefera

(74) *Attorney, Agent, or Firm* — Hanley, Flight & Zimmerman, LLC

(57) ABSTRACT

Adjustable frames for use with hanging folders and related methods are disclosed herein. An example apparatus includes an adjustable frame for hanging folders. The frame is to couple to a first rail and a second rail spaced relative to each other to cooperatively receive a first folder. The frame is movable between an expanded position and a contracted position to enable the first and second rails to receive a second folder sized differently relative to the first folder. The example apparatus also includes a receptacle disposed on the frame to receive a first clip for coupling the first rail to the frame.

17 Claims, 10 Drawing Sheets

(56) References Cited

U.S. PATENT DOCUMENTS

| | | | | | |
|---|---|---|---|---|---|
| 4,091,933 | A | | 5/1978 | Alexander | |
| 4,176,753 | A | * | 12/1979 | Godfrey | B42F 15/0094 211/182 |
| 4,219,247 | A | * | 8/1980 | Litchfield | A47B 88/00 312/184 |
| 4,765,490 | A | * | 8/1988 | Hanson | B42F 15/0094 211/175 |
| 5,042,769 | A | * | 8/1991 | Smed | B42F 15/0094 248/230.7 |
| 5,071,014 | A | * | 12/1991 | Robinson | A47B 43/00 211/162 |
| 5,205,626 | A | * | 4/1993 | Fotioo | B42F 15/0094 211/189 |
| 5,255,798 | A | * | 10/1993 | Aaldenberg | A47B 45/00 211/46 |
| 5,396,995 | A | | 3/1995 | Turek | |
| 5,405,020 | A | | 4/1995 | Fotioo | |
| 5,570,792 | A | * | 11/1996 | Huang | B42F 15/0094 211/189 |
| 5,873,642 | A | * | 2/1999 | Domenig | B42F 15/0094 16/93 R |
| D702,463 | S | * | 4/2014 | Stanavich | D6/683.1 |
| 9,642,457 | B1 | | 5/2017 | Halfen et al. | |
| 2003/0038565 | A1 | * | 2/2003 | Walla | A47B 96/06 312/184 |
| 2008/0169737 | A1 | * | 7/2008 | Shen | A47B 45/00 312/205 |

* cited by examiner 140
300
114
200
312
310
314
318
316
323
322
324
302
306
309
330
340
346
350
352
334
338
342
304
331
326
336
308
332
354
344
348
370
204
358
328
372
374
368
360
364
362
356
366
320
202
a
b

ADJUSTABLE FRAMES FOR USE WITH HANGING FOLDERS AND RELATED METHODS

FIELD OF THE DISCLOSURE

This disclosure relates generally adjustable frames and, more particularly, to adjustable frames for use with hanging folders and related methods.

BACKGROUND

A file cabinet may include drawers containing folders for files or paper. Often, a metallic frame is positioned in a cabinet drawer to support the folders and enable the folders to hang from rails coupled to the frame. The folders are able to move along the rails within the file cabinet.

BRIEF DESCRIPTION OF THE DRAWINGS

The figures are not to scale. Wherever possible, the same reference numbers will be used throughout the drawing(s) and accompanying written description to refer to the same or like parts.

DETAILED DESCRIPTION

Figure 1:
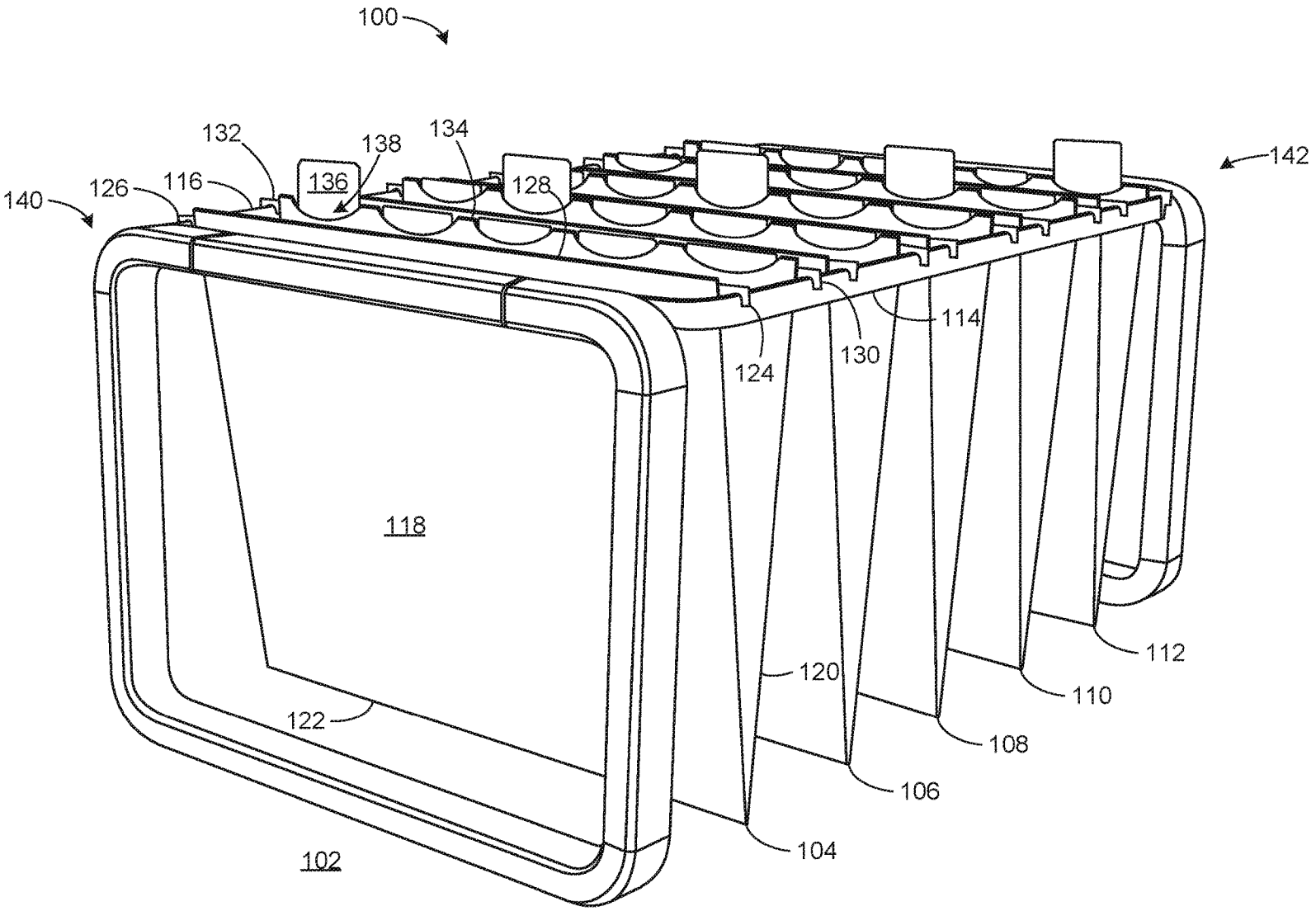
FIG. 1 is a schematic illustration of an example adjustable frame in accordance with examples disclosed herein.

Known frames for hanging folders are typically sized in accordance with only one file or paper size, such as 8.5 inches by 11 inches (sometimes referred to as "letter" or "United States (U.S.) letter"), 8.5 inches by 14 inches (sometimes referred to as "legal"), etc. Such known frames may be difficult to assemble and/or disassemble when implemented in a file cabinet (sometimes referred to as a "filing cabinet"). Further, assembly and/or adjustment of these known frames may be labor intensive (e.g., requiring screws, nuts, bolts, etc. to couple a known frame to a drawer wall of the file cabinet), and there are significant costs to replace or supplement the frames with additional frames corresponding to different file or paper sizes.

Adjustable frames for use with hanging folders and related methods are disclosed. Examples disclosed herein provide an adjustable frame having a first portion movable relative to a second portion, which enables the frame to adjust (e.g., expand and/or contract via user input) in accordance with different paper sizes (e.g., letter, legal, etc.). The example frame includes rails to support one or more folders and/or elevate the folder(s) relative to a surface on which the frame is positioned such as, for example, a drawer of a file cabinet or a desktop. In some examples, the example frame supports the folder(s) without coupling to a support structure (e.g., a drawer wall of a file cabinet) via screws, nuts, bolts, adhesives, and/or any other mechanical and/or chemical fastener or combination of fasteners that would have otherwise been required by the above known noted frames. As such, the example frame may easily adjust between an expanded position and a contracted position to support differently sized folders, which would otherwise be unattainable using the above noted known frames. Thus, examples disclosed herein may reduce labor and/or costs associated with the above noted known frames.

An example adjustable frame includes one or more tracks interposed between a first portion and a second portion of the adjustable frame to facilitate movement thereof. For example, an example track slidably couples to the first portion and the second portion of the frame to maintain an orientation of the first portion relative to the second portion. In particular, the track couples to and/or decouples from the first portion of the frame to provide different positions of the first portion relative to the track such that a person may easily move the first portion between the different positions (e.g., cause the adjustable frame to expand and/or contract). Similarly, in some examples, the track couples to and/or decouples from the second portion of the frame to provide different positions of the second portion relative to the track, such that the person may easily move the second portion between the different positions (e.g., cause the adjustable frame to expand and/or contract). In this manner, the adjustable frame is easily movable between a contracted position (e.g., corresponding to one or more letter sized files) and an expanded position (e.g., corresponding to one or more legal sized files).

Some disclosed examples provide an adjustment system to define the expanded and/or the contracted position of the adjustable frame as well as guide and/or limit movement of the track relative to the first portion and/or the second portion of the frame, which is disclosed in greater detail below in connection with FIGS. 3A-C. In some examples, the adjustment system includes one or more bosses disposed on the first frame (e.g., disposed on the first portion and/or the second portion of the first frame) to engage the track. In such examples, the track includes one or more apertures to receive the bosses as the track moves relative to one or both of the portions, thereby defining the expanded and/or the contracted position of the frame when a boss is aligned with and positioned in a respective aperture. In particular, an example boss may be disposed on a resilient and/or a flexible portion of the frame to enable the boss to easily move into and/or out of a respective one of the apertures.

In some examples, the adjustment system includes one or more rails disposed on the frame (e.g., disposed on the first portion and/or the second portion of the frame) to engage the track, which guides movement of the frame and/or retains the portions of the frame in the track. In such examples, the track includes one or more grooves to receive the rail(s). For example, an example rail positioned on the first portion of the frame extends into or through a first example groove of the track, thereby retaining the first portion in the track between a first wall and a second wall of the track.

In some examples, the adjustment system includes one or more protrusions disposed on the frame (e.g., disposed on the first portion and/or the second portion of the frame) to engage the track, which prevents the portion(s) of the frame from separating from the track. In such examples, the track includes one or more additional grooves to receive the protrusion(s). For example, an example protrusion positioned on the first portion of the frame extends into or through a second example groove of the track to engage an end of the second groove, thereby limiting a range of movement of the track relative to the first portion as well as preventing the first portion from separating from the track (e.g., when the frame is in an expanded position).

Some disclosed examples include one or more clips interposed between the first rail and the second rail. Such example clips facilitate assembly of the frame with the first rail and/or the second rail as well as improve loading performance of the frame. For example, an example clip includes a receptacle to receive a portion of the first rail or the second rail as well as means for coupling the rail thereto. In some examples, the clip includes at least an extension portion to be received in a receptacle positioned on the first portion and/or the second portion of the frame, which effectively distributes stress imparted on the frame by the clip. In such examples, the extension portion of the clip includes a tooth to engage a surface of a groove formed by an inner surface of the receptacle (e.g., when the extension of the clip passes through the receptacle), thereby coupling the clip to the frame.

In this manner, the example clip ensures a proper orientation of the rails relative to each other. For example, the tooth only engages the surface of the groove when the clip has a particular orientation relative to the frame (e.g., such that the first rail extends away from the second rail when coupled to the first clip). Accordingly, the clip may not couple to the frame when improperly oriented (e.g., when the first rail extends toward the second rail), which facilitates assembly of the example frame with the example clip(s) and rail(s) by preventing user error.

FIG. 1 is a schematic illustration of an example adjustable frame assembly 100 for hanging folders in accordance with examples disclosed herein. The example adjustable frame assembly 100 of FIG. 1 supports one or more folders and/or elevates the folder(s) relative to a surface (e.g., a surface of one or more of a desk, a cabinet (e.g., a filing cabinet), a table, a floor, etc.) 102 on which the frame assembly 100 is placed, such that the folder(s) do not contact the surface 102. For example, as shown in FIG. 1, a first folder 104, a second folder 106, a third folder 108, a fourth folder 110, and a fifth folder 112 hang on a first rail 114 and a second rail 116 of the adjustable frame assembly 100. While FIG. 1 depicts five folders, in other examples, additional or fewer folders may be used. Each of the folders 104, 106, 108, 110, 112 of FIG. 1 is sized to receive one or more files and/or papers having a first size such as, for example, 8.5 inches by 11 inches (i.e., letter sized). In other examples, each of the folder(s) 104, 106, 108, 110, 112 may be sized to receive differently sized (e.g., smaller, larger, and/or wider) file(s) and/or paper(s) relative to the first size. For example, the folders can be sized to receive legal sized documents, A4, ledger, folio, executive, half letter, tabloid, index card, and/or any other standard or non-standard sizes. In such examples, the adjustable frame 100 assembly adjusts (e.g., expands and/or contracts via user input) to provide support to the folder(s) 104, 106, 108, 110, 112 based on their size, which is disclosed in greater detail below in connection with FIGS. 2A and 2B. The sizes disclosed herein relate to the standard sizes of the file folders themselves and do not limit the size of items that may be disposed therein. For example, papers, files, and/or other items smaller than letter sized may be stored in a letter sized file. Likewise, larger items that are folded to reduce their form factor may also be stored therein.

The first example rail 114 and the second example rail 116 of FIG. 1 may be constructed of one or more metallic materials, plastic materials, and/or combination of materials such that the rails 114, 116 cooperatively support the folder(s) 104, 106, 108, 110, 112 and/or contents therein without breaking, cracking, etc. In some examples, each of the rails 114, 116 may have a particular cross-sectional shape to improve structural performance and/or reduce weight thereof, which is disclosed in greater detail below in connection with FIGS. 4A and 4B.

In the example of FIG. 1, the first example folder 104 (and/or the second folder 106, the third folder 108, the fourth folder 110, the fifth folder 112, etc.) includes a first cover 118 coupled to a second cover 120 via a hinge 122 to cooperatively receive one or more files and/or other items disposed therein. In some examples, to enable the first folder 104 to hang and/or move along the rails 114, 116, the first folder 104 (and/or the second folder 106, the third folder 108, the fourth folder 110, the fifth folder 112, etc.) includes means for engaging the first rail 114 and/or the second rail 116. For example, the first folder 104 includes a first hanger portion or hook 124 disposed on a first side of the first cover 118 to engage the first rail 114 and a second hanger portion or hook 126 disposed on a second side of the first cover 118, opposite the first side, to engage the second rail 116, thereby enabling the first cover 118 to hang from the rails 114, 116 such that the hinge 122 of the first folder 104 does not contact the surface 102.

The first hanger portion 124 and the second hanger portion 126 of FIG. 1 are coupled to each other through a rod that extends through the first cover 118 along a first edge 128 of the first cover 118 to provide support and reduce stress on the first cover 118. Further, in the example of FIG. 1, the first folder 104 (and/or the second folder 106, the third folder 108, the fourth folder 110, the fifth folder 112, etc.) likewise includes a third hanger portion or hook 130 disposed on a first side of the second cover 120 to engage the first rail 114 and a fourth hanger portion or hook 132 disposed on a second side of the second cover 120 to engage the second rail 116, thereby enabling the second cover 120 to hang from the rails 114, 116. The third hanger portion 130 and the fourth hanger portion 132 of FIG. 1 are similarly coupled together via a rod that extends through the second cover 120 along a second edge 134 of the second cover 120. The hanger portions 124, 126, 130, 132 also enable the file folder 104 to slide along the rails 114, 116.

In some examples, to facilitate organizing and/or managing files, the first example folder 104 (and/or the second folder 106, the third folder 108, the fourth folder 110, the fifth folder 112, etc.) of FIG. 1 includes a first indexing tab 136. The first indexing tab 136 enables a person to visually associate files disposed in the first folder 104 with text, labels, visual indicators, etc. disposed on the first tab 136. The example first indexing tab 136 of FIG. 1 is movable into and out of a pocket 138 formed by the second cover 120. While FIG. 1 depicts the first folder 104 implemented with five indexing tabs that are each disposed in a respective pocket formed by the second cover 120, in other examples, the first folder 104 may be implemented with additional or fewer indexing tabs and/or pockets. Further, while FIG. 1 discloses aspects in connection with the first folder 104, in other examples, such aspects likewise apply to one or more of the second example folder 106, the third example folder 108, the example fourth folder 110, the example fifth folder 112, etc.

In the example of FIG. 1, the first rail 114 and the second rail 116 are coupled to a first adjustable end frame 140 and extend away therefrom to cooperatively receive the folder(s) 104, 106, 108, 110, 112. In some examples, to facilitate assembling and/or increase loading capacity of the adjustable frame assembly 100 with the first rail 114 and/or the second rail 116, the first adjustable end frame 140 is implemented with a first clip 402 and/or a second clip 404 (both shown in FIGS. 4A and 4C) for coupling the rail(s) 114, 116 to the first adjustable end frame 140, as disclosed in greater detail below in connection with FIGS. 4A, 4C, 5 and 6A-C.

In the example of FIG. 1, similar to the first adjustable end frame 140, the first rail 114 and the second rail 116 are coupled (e.g., via one or more clips) to a second example adjustable end frame 142. The second adjustable end frame 142 of FIG. 1 is spaced from the first adjustable end frame 140 such that the folder(s) 104, 106, 108, 110, 112 are supported and/or positioned therebetween. In some examples, the first adjustable end frame 140 and/or the second adjustable end frame 142 support the folder(s) 104, 106, 108, 110, 112 without coupling to a support structure (e.g., a drawer wall of a file cabinet) via screws, nuts, bolts, adhesives, and/or any other mechanical and/or chemical fastener or combination of fasteners. For example, one or both of the first adjustable end frame 140 and/or the second adjustable end frame 142 is/are implemented with a sufficiently large and/or flat outer surface that provide support for allowing the assembly 100 to be free standing.

While the example of FIG. 1 depicts the first adjustable end frame 140 and the second adjustable end frame 142 cooperatively supporting the rails 114, 116 and/or the folder(s) 104, 106, 108, 110, 112, in other examples, only the first adjustable end frame 140 or the second adjustable end frame 142 may be used. For example, the rails 114, 116 may be positioned on a single adjustable end frame 140, 142 along a center of the rails 114, 116 to balance the adjustable frame assembly 100. Further, when one adjustable end frame 140, 142 is implemented without the other, a lowermost or bottom portion of the adjustable end frame 140, 142 contacting the surface 102 may be substantially larger and/or wider to prevent the adjustable frame assembly 100 from tilting. Additionally or alternatively, in such examples, the first rail 114 and/or the second rail 116 may extend away from the adjustable end frame 140, 142 and be coupled to an external support structure (e.g., a wall a drawer of a file cabinet) to cooperatively support the folder(s) 104, 106, 108, 110, 112 and/or prevent the adjustable frame assembly 100 and/or the rails 114, 116 from tilting and/or falling over. However, by using both the first adjustable end frame 140 and the second adjustable end frame 142, the rails 114, 116 and/or the folder(s) 104, 106, 108, 110, 112 may be more stable and/or better supported (e.g., when the folder(s) 104, 106, 108, 110, 112 have files contained therein).

In such examples, to facilitate assembling and/or increase loading capacity of the second adjustable end frame 142 with the first rail 114 and/or the second rail 116, the second adjustable end frame 142 is implemented with a third clip 422 and/or a fourth clip 424 (both shown in FIG. 4C) for coupling the rail(s) 114, 116 to the second adjustable end frame 142, as disclosed in greater detail below in connection with FIGS. 4C, 5, and 6A-C.

Figure 2A:
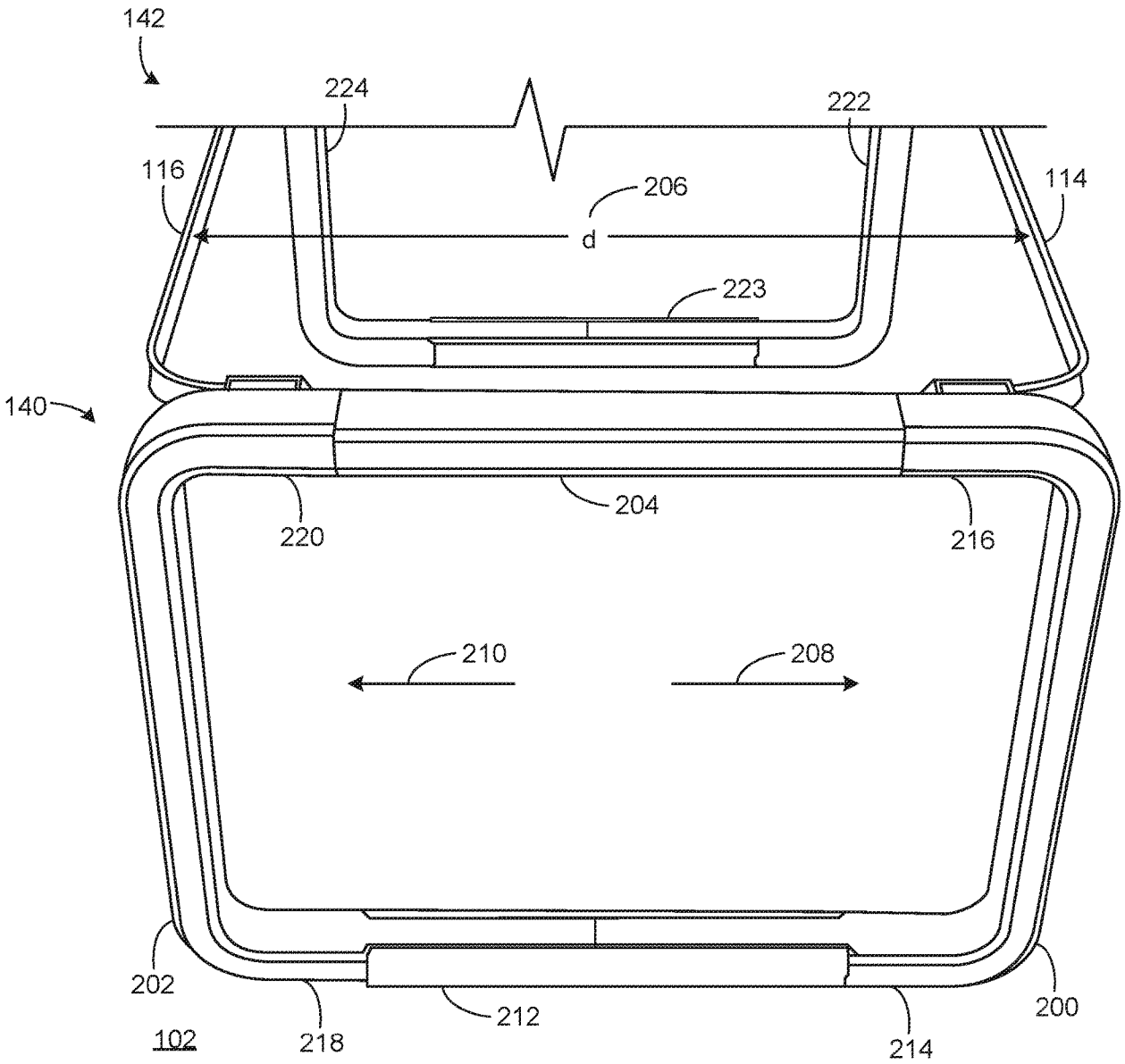
FIG. 2A is a front view of the example adjustable frame of FIG. 1 in a first position.
Figure 2B:
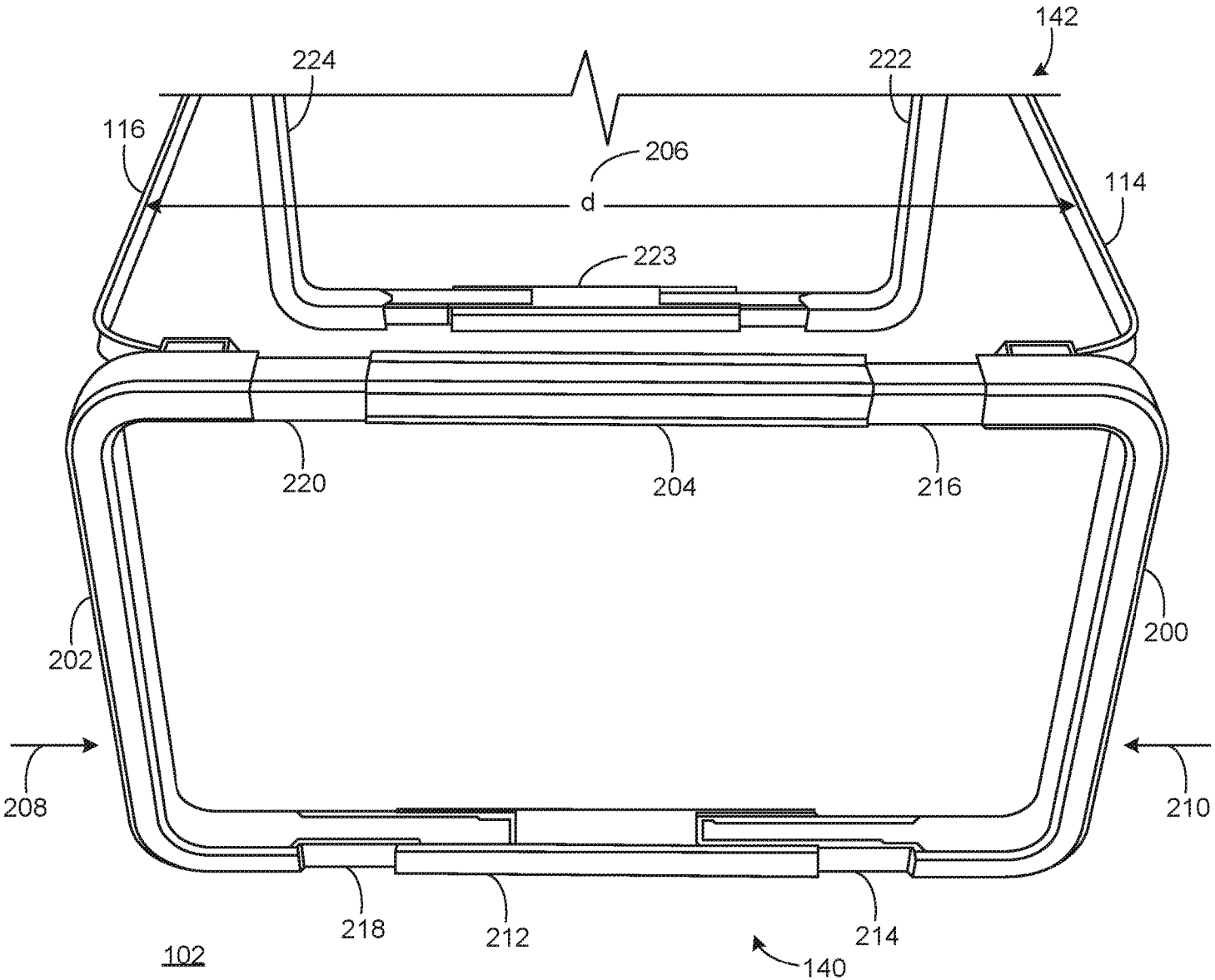
FIG. 2B is a front view of the example adjustable frame of FIG. 1 in a second position.

FIGS. 2A and 2B are front views of the example first adjustable end frame 140 of FIG. 1 and show different positions thereof. In FIG. 2A, the first adjustable end frame 140 is in a contracted position (e.g., for letter sized files), and in FIG. 2B, the first adjustable end frame 140 is in an expanded position (e.g., for legal sized files). In the example of FIGS. 2A and 2B, the example first adjustable end frame 140 includes a first portion 200 moveable relative to a second portion 202. In some examples, a first example track 204 is interposed between at least a portion of the first portion 200 and at least a portion of the second portion 202 to facilitate movement thereof and/or to maintain the relative positioning of the first portion 200 and the second portion 202, which is disclosed in greater detail below in connection with FIGS. 3A-C. In particular, the first track 204 of FIGS. 2A and 2B is slidably coupled to the first portion 200 and the second portion 202 of the example first adjustable end frame 140 to enable the first portion 200 to move toward and/or away from the second portion 202 while maintaining an orientation of the first portion 200 relative to the second portion 202. In this manner, in addition to the first adjustable end frame 140 supporting one or more folders corresponding to a first size (e.g., 8.5 inches by 11 inches), the first adjustable end frame 140 may be adjusted to support one or more folders corresponding to second size (e.g., 8.5 inches by 14 inches), a third size, etc.

Further, as disclosed in greater detail below, the first track 204 of FIGS. 2A and 2B enables each of the first portion 200 and the second portion 202 of the first adjustable end frame 140 to couple to and/or decouple from the first track 204 at pre-defined positions, which facilitates adjustment of the first adjustable end frame 140 by a person, as disclosed in greater detail below in connection with FIGS. 3A-C. In such examples, the first track 204 guides and/or limits the movement between the first portion 200 and the second portion 202 of the first adjustable end frame 140, for example, to prevent the first track 204 from separating from the first portion 200 and/or the second portion 202.

As shown in FIG. 2A, the first portion 200 is in a first position relative to the first track 204 and/or the second portion 202, for example, to define a contracted position of the first adjustable end frame 140. As such, a distance 206 (e.g., corresponding to letter sized files) is defined between the first rail 114 and the second rail 116. In some examples, the first adjustable end frame 140 expands (e.g., the first portion 200 and/or the second portion 202 move(s) away from the first track 204) to increase the distance 206. For example, as shown in FIG. 2B, the first portion 200 is in a second position relative to the first track 204 and/or the second portion 202, for example, to define an expanded position of the first adjustable end frame 140. In such examples, to move the first portion 200 from the first position to the second position, a force (e.g., generated by a person) is provided to and/or imparted on the first portion 200 directed substantially in a first direction 208 away from the second portion 202. In addition, in some examples, the first adjustable end frame 140 contracts (e.g., the first portion 200 and/or the second portion 202 move(s) toward the first track 204) to decrease the distance 206. For example, the force may be provided to and/or imparted on the first portion 200 directed substantially in a second direction 210, opposite the first direction 208, to move the first portion 200 from the second position to the first position.

In some examples, the first portion 200 of the first adjustable end frame 140 is proximate to (e.g., within about 0.1 inches, about 0.5 inches, etc.) and/or engages the second portion 202 when in the first position shown in FIG. 2A. In addition, in some examples, the first portion 200 is substantially spaced (e.g., by about 2 inches, about 4 inches, about 6 inches, etc.) from the second portion 202 when in the second position shown in FIG. 2B.

Similar to the first portion 200, the second portion 202 of the first adjustable end frame 140 of FIGS. 2A and 2B is in a first position relative to the first track 204 and/or the first portion 200. In some examples, as previously mentioned, the first adjustable end frame 140 expands to increase the distance 206. For example, as shown in FIG. 2B, the second portion 202 is in a second position relative to the first track 204 and/or the first portion 200. In such examples, to move the second portion 202 from the first position to the second position, a force is provided to and/or imparted the second portion 202 directed substantially in the second direction 210 away from the first portion 200. In addition, when the first adjustable end frame 140 contracts to decrease the distance 206, the force may be provided to and/or imparted on the second portion 202 directed substantially in the first direction 208, opposite the second direction 210, to move the second portion 202 from the second position to the first position. Thus, in some examples, the first adjustable end frame 140 expands and/or contracts via moving the first portion 200 and/or the second portion 202.

Similar to the first track 204, the first adjustable end frame 140 of FIGS. 2A and 2B is implemented with a second example track 212 interposed between the first portion 200 and the second portion 202 to further facilitate, guide, and/or limit movement thereof. As shown in FIGS. 2A and 2B, the first track 204 is disposed on an upper portion (in the orientation of FIGS. 2A and 2B) of the first adjustable end frame 140, and the second track 212 is disposed on a lower portion (in the orientation of FIGS. 2A and 2B) of the first adjustable end frame 140.

While FIGS. 2A and 2B depict the first adjustable end frame 140 implemented with the first example track 204 and the second example track 212, in other examples, additional or fewer tracks may be used. However, the first track 204 and the second example track 212 may together provide increased strength and/or rigidity to the first adjustable end frame 140 than attainable using only the first track 204 or only the second track 212. The increased stability helps maintain the orientation of the first rail 114 relative to the second rail 116 as well as increases structural integrity and/or performance of the first adjustable end frame 140.

In the example of FIGS. 2A and 2B, the first portion 200 of the first adjustable end frame 140 includes a first side 214 positioned on the surface 102 and a second side 216 spaced therefrom to elevate the first rail 114. In some examples, the first portion 200 of the first adjustable end frame 140 includes one or more plastic materials (e.g., Acrylonitrile-Butadiene-Styrene (ABS)) and may be implemented using one or more suitable structures, such as a beam, a rod, etc. Similarly, the second portion 202 of the first adjustable end frame 140 likewise includes a first side 218 positioned on the surface 102 and a second side 220 spaced therefrom to elevate the second rail 116. Further, the second portion 202 of the first adjustable end frame 140 may include one or more plastic materials and may be implemented using one or more suitable structures, such as a beam, a rod, etc. In some examples, as shown in FIGS. 2A and 2B, the first portion 200 and/or the second portion 202 of the first adjustable end frame 140 are U-shaped.

Further, while FIGS. 2A and 2B depict aspects in connection with the first adjustable end frame 140, in other examples, such aspects may likewise apply to the second adjustable end frame 142. For example, the second adjustable end frame 142 of FIGS. 2A and 2B expands and/or contracts to change the distance 206 between the first rail 114 and the second rail 116. In some examples, the second adjustable end frame 142 is implemented with a first portion 222 a second portion 224 movable relative to each other, as shown in FIGS. 2A and 2B. In such examples, a third track (e.g., an upper track) 420 (shown in FIG. 4C) and a fourth track 223 (e.g., a lower track) are interposed between the first portion 222 and the second portion 224 of the second adjustable end frame 142 to facilitate, guide, and/or limit movement thereof, one of which is shown.

Figures 3A, 3B, 3C:
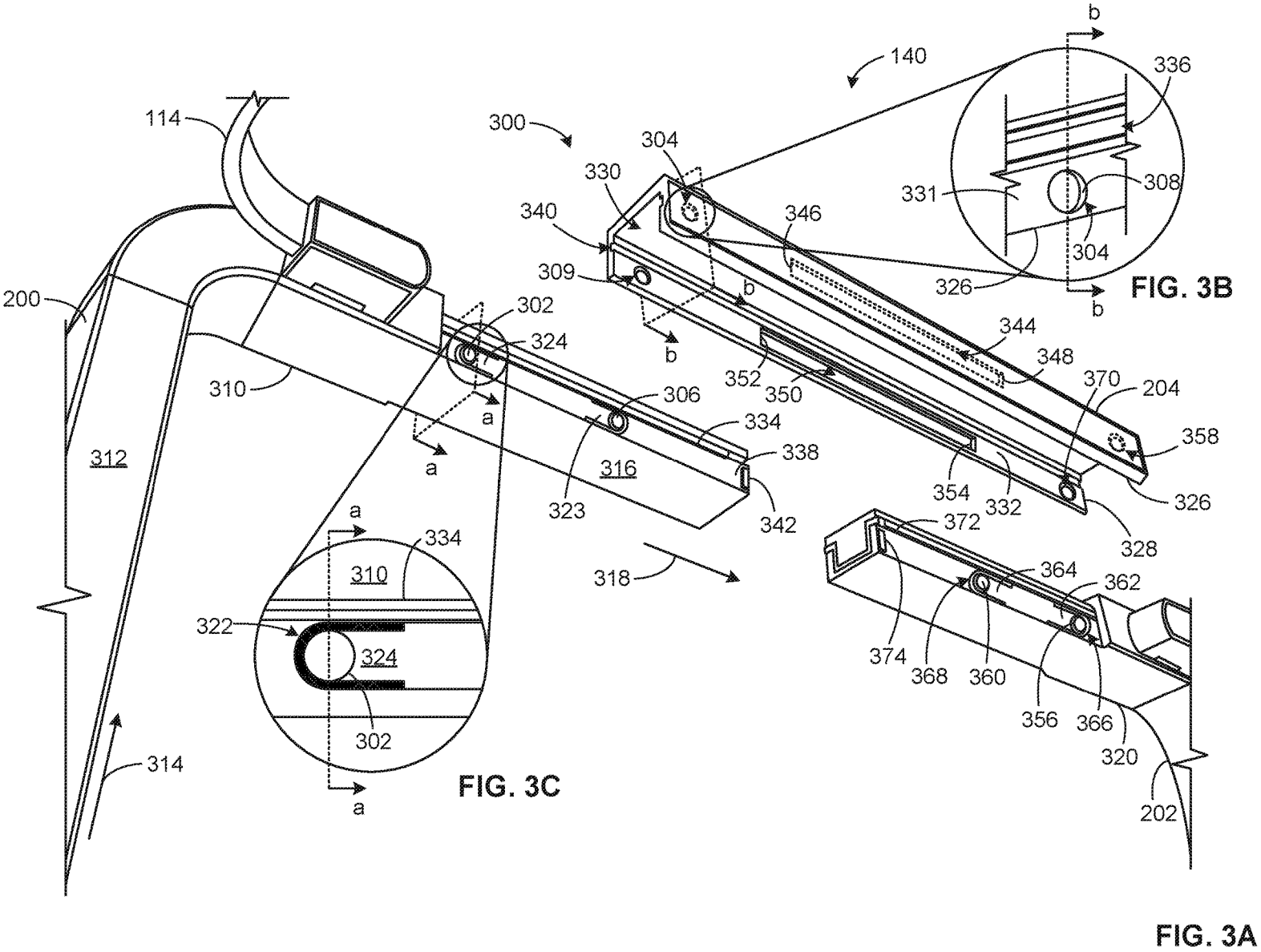
FIG. 3A is an exploded-view of a portion of the example adjustable frame of FIG. 1 and shows an example adjustment system in accordance with examples disclosed herein.
FIG. 3B is an enlarged view of a portion of an example track in accordance with examples disclosed herein.
FIG. 3C is an enlarged view of a portion of the example adjustable frame of FIG. 1.

FIG. 3A is a partial exploded-view of the example first adjustable end frame 140 of FIG. 1 and shows an example adjustment system 300. The adjustment system 300 provides for the above disclosed positions of the first portion 200 and/or the second portion 202 of the first adjustable end frame 140 relative to the first track 204 (and/or the second track 212), which facilitates manual adjustment by the person based on one or more sizes of the folder(s) 104, 106, 108, 110, 112. The example adjustment system 300 may be implemented using the first example portion 200 of the first adjustable end frame 140, the second example portion 202 of the first adjustable end frame 140, the first example track 204, and/or the second example track 212.

In some examples, the adjustment system 300 of FIGS. 3A-C includes a first boss or protrusion 302 disposed on the first portion 200 of the first adjustable end frame 140 to engage the first track 204. In particular, the adjustment system 300 includes a first aperture or groove 304 (FIG. 3B) disposed on the first track 204 to receive the first boss 302 when the first boss 302 aligns to the first aperture 304, thereby coupling the first portion 200 to the first track 204 and/or fixing a position of the first portion 200 relative to the first track 204. As such, the above disclosed first position of the first portion 200 relative to the first track 204 is defined by a location of the first boss 302 on first portion 200 as well as a location of the first aperture 304 on the first track 204. Further, in some examples, the adjustment system 300 includes a second boss or protrusion 306 disposed on the first track 204, spaced from the first boss 302, to likewise extend into or through the first aperture 304 and/or engage the first track 204 when the second boss 306 aligns to the first aperture 304, thereby coupling the first portion 200 to the first track 204 and/or fixing a position of the first portion 200 relative to the first track 204. As such, the above disclosed second position of the first portion 200 relative to the first track 204 is defined by a location of the second boss 306 on first portion 200 as well as the location of the first aperture 304 on the first track 204.

In some examples, to decouple the first portion 200 from the first track 204 and/or move the first portion 200 relative to the first track 204 from the first position and/or the second position (e.g., to enable the first adjustable end frame 140 to expand and/or contract), each of the first boss 302 and/or the second boss 306 includes a curved and/or angled outer surface 702 (shown in FIG. 7A) to engage an inner surface 308 defined by the first aperture 304, such that the bosses 302, 306 move out of the first aperture 304 in response to the first portion 200 receiving the force directed in the first direction 208 or the second direction 210 having a magnitude greater than one or more threshold magnitudes (e.g., about 1 pound-force, about 2 pound-force, about 5 pound-force, etc.). For example, the example adjustment system 300 maintains the first position of the first portion 200 relative to the first track 204 until the force imparted on the first portion 200 exceeds a first example threshold magnitude associated with the first boss 302. Similarly, the example adjustment system 300 maintains the second position of the first portion 200 relative to the first track 204 until the force imparted on the first portion 200 exceeds a second example threshold magnitude associated with the second boss 306. In such examples, the first threshold magnitude and/or the second threshold magnitude may be affected and/or defined by geometric parameters of a respective one of bosses 302, 306, as disclosed in greater detail below in connection with FIG. 7A.

In some examples, although not shown, the example first portion 200 of the first adjustable end frame 140 includes one or more additional bosses, similar to the first boss 302 and/or the second boss 306, to engage the first track 204. In such examples, as shown in FIG. 3A, the first track 204 includes a second aperture or groove 309 to receive a third boss or protrusion 708 (shown in FIG. 7A) positioned on the first portion 200 and/or a fourth boss or protrusion positioned on the first portion 200 adjacent the third boss 708. The second aperture 309 of FIG. 3A is positioned on the inner surface 332 of the second wall 328 of the first track 204 opposite the first aperture 304.

The first portion 200 of the first example adjustable end frame 140 of FIGS. 3A and 3C includes an example first arm 310 having a first leg 312 extending in a third direction (e.g., a vertical direction) 314 to elevate and/or support the first rail 114. The first arm 310 of FIGS. 3A and 3C includes a second leg 316 extending in a second direction (e.g., a horizontal direction) 318 toward a second arm 320 of the first adjustable end frame 140. As shown in FIGS. 3A and 3C, the first arm 310 includes and/or defines the first boss 302 and the second boss 306 (and/or the third boss 708 and the fourth boss). In some examples to facilitate movement of the first boss 302 into and/or out of the first aperture 304, a first recess (e.g., a U-shaped recess) 322 (FIG. 3C) is positioned adjacent and/or at least partially surrounds the first boss 302 and extends to a cavity (shown in FIG. 7A) 714 within the first arm 310 to define a flexible and/or resilient portion 324 of an outer surface of the first arm 310. In some examples, the first recess 322 extends from the first boss 302 toward the first track 204 and/or away from the first boss 302, which may affect the above disclosed first threshold magnitude associated with enabling the first portion 200 of the first adjustable end frame 140 to unlock relative to and/or decouple from the first track 204 via the first boss 302 and the first aperture 304. For example, the first threshold magnitude is reduced when the first recess 322 extends a greater length along the first arm 310. Similarly, in some examples, a second resilient portion 323 (e.g., defined by a recess disposed on the first arm 310) is likewise formed by or on the first arm 310 and includes the second boss 306, which may affect the above disclosed second threshold magnitude associated with enabling the first portion 200 of the first adjustable end frame 140 to unlock relative to and/or decouple from the first track 204 via the second boss 306 and the first aperture 304.

In the example of FIG. 3A, the example first track 204 includes a first wall 326 and a second wall 328 defining a space 330 therebetween to receive the first portion 200 and the second portion 202 of the first adjustable end frame 140. An inner surface (e.g., a flat or level surface) 331 (FIG. 3B) of the first wall 326 and an inner surface (e.g., a flat or level surface) 332 of the second wall 328 cooperatively engage the second leg 316 of the first arm 310 to guide relative movement between the first portion 200 of the first adjustable end frame 140 and the first track 204. Likewise, the inner surfaces 331, 332 also engage the second arm 320 to guide relative movement between the second portion 202 of the first adjustable end frame 140 and the first track 204. As a result, the first wall 326 and the second wall 328 of the first track 204 enable the first portion 200 and the second portion 202 of the first adjustable end frame 140 to move toward and/or away from each other while maintaining an orientation of the first portion 200 relative to the second portion 202. Stated differently, the first portion 200 and the second portion 202 are enabled to move relative to each other while not rotating and/or tilting relative to each other.

In some examples, to retain the first arm 310 in the first track 204 and/or further guide movement thereof, the example adjustment system 300 of FIGS. 3A-C includes a third rail 334 disposed on the first arm 310 of the first portion 200 of the first adjustable end frame 140. In the example of FIG. 3A, the third rail 334 extends along a length of the second leg 316 of the first arm 310 to be received by and/or engage the first track 204. In particular, the third rail 334 is to extend into or through a first groove 336 (FIG. 3B) disposed on first track 204 (e.g., formed by the inner surface 331 of the first wall 326). By implementing the example adjustment system 300 with the third rail 334 and the first groove 336, relative movement between the first portion 200 of the first adjustable end frame 140 and the first track 204 is further limited and/or better guided.

In some examples, the example adjustment system 300 of FIGS. 3A-C includes a fourth rail 716 (shown in FIG. 7A) disposed on the first arm 310 opposite the third rail 334. In such examples, the fourth rail 716 is to extend into or through a second groove 340 disposed on the of the second wall 328 of the first track 204 (e.g., formed by the inner surface 332 of the second wall 328) and engage the first track 204.

In some examples, to retain the first arm 310 in the first track 204 and/or prevent the first arm 310 from separating from the first track 204, the example adjustment system 300 of FIG. 3A includes a first protrusion 342 disposed on the first side 338 of the second leg 316 of the first arm 310 to be received by the first track 204. In this example, the first protrusion 342 of FIG. 3A includes a shape that is substantially rectangular and extends away from the first arm 310. In other examples, the first protrusion 342 includes one or more other suitable shapes, such as a circle, a regular polygon (e.g., a square, a regular hexagon, etc.), an irregular polygon (e.g., a trapezoid, a rhombus, etc.), etc. In particular, the first protrusion 342 of FIG. 3A is to extend into or through a third groove 344 disposed on the first wall 326 of the first track 204 (e.g., formed by the inner surface 331 of the first wall 326), adjacent the first aperture 304 and/or the second aperture 309, and engage the first track 204. In such examples, a range of movement between the first portion 200 of the first adjustable end frame 140 and the first track 204 is defined by a length of the third groove 344. For example, the first protrusion 342 of FIG. 3A engages a first end 346 of third groove 344 to limit expansion of the first adjustable end frame 140. Similarly, the first protrusion 342 engages a second end 348, opposite the first end 346, to limit contraction of the first adjustable end frame 140.

In some examples, the example adjustment system 300 of FIGS. 3A-C similarly includes a second protrusion disposed on the second leg 316 of the first arm 310, opposite the first protrusion 342, to be received by the first track 204. In such examples, as shown in FIG. 3A, the second protrusion is to extend into or through a fourth groove 350 disposed on the second wall 328 of the first track 204 (e.g., formed by the inner surface 332 of the second wall 328) and engage the first track 204. The fourth groove 350 of FIG. 3A includes a first end 352 associated with limiting expansion of the first adjustable end frame 140 and a second end 354, opposite the first end 352, associated with limiting contraction of the first adjustable end frame 140.

In some examples, similar to the above disclosed first boss 302, the second boss 306, the third boss 708 and/or the fourth boss, the second portion 202 of the first adjustable end frame 140 includes one or more bosses to engage the first track 204, thereby coupling the second portion 202 to the first track 204 and/or fixing one or more positions of the second portion 202 relative to the first track 204. As shown in FIG. 3A, a fifth boss or protrusion 356 is disposed on the second arm 320 to extend into or through a third aperture or groove 358 disposed on the first wall 326 of the first track 204 (e.g., formed by the inner surface 331 of the first wall 326) when the fifth boss 356 aligns to the third aperture 358, which defines the above disclosed first position of the second portion 202 relative to the first track 204. Further, the second arm 320 of FIG. 3A includes a sixth boss or protrusion 360, spaced from the fifth boss 356, to extend into or through the third aperture 358 when the sixth boss 360 aligns to the third aperture 358, which defines the above disclosed second position of the second portion 202 relative to the first track 204.

Figure 7A:
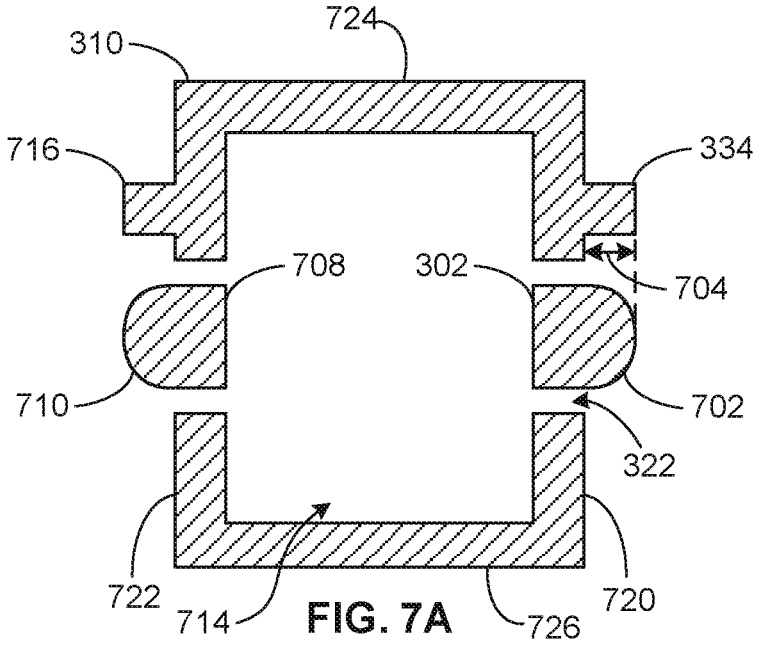
FIG. 7A is a cross-sectional view of the example frame of FIG. 1 taken along the a-a line of FIG. 3A.

In some such examples, to decouple the second portion 202 of the first adjustable end frame 140 from the first track 204 and/or move the second portion 202 relative to the first track 204 from the first position and/or the second position (e.g., enable the first adjustable end frame 140 to expand and/or contract), the fifth boss 356 and/or the sixth boss 360 include a curved and/or angled outer surface (e.g., the curved and/or angled outer surface 702 of the first boss 302 shown in FIG. 7A) to engage a surface defined by the third aperture 358, such that the fifth boss 356 and/or the sixth boss 360 moves out of the third aperture 358 in response to the second portion 202 receiving a force directed in the first direction 208 or the second direction 210 having a magnitude greater than one or more threshold magnitudes (e.g., about 1 pound-force, about 2 pound-force, about 5 pound-force, etc.). Accordingly, the example adjustment system 300 of FIGS. 3A-C maintains the first position of the second portion 202 of the first adjustable end frame 140 relative to the first track 204 until the force imparted on the second portion 202 exceeds a third example threshold magnitude associated with the fifth boss 356. Similarly, the example adjustment system 300 of FIGS. 3A-C maintains the second position of the second portion 202 relative to the first track 204 until the force imparted on the second portion 202 exceeds a fourth example threshold magnitude associated with the sixth boss 360.

In some examples, to facilitate movement of the fifth boss 356 into and/or out of the third aperture 358, the second arm 320 includes a third resilient portion 362 having the fifth boss 356 positioned thereon, which may affect the above disclosed third threshold magnitude associated with enabling the second portion 202 of the first adjustable end frame 140 to unlock relative to and/or decouple from the first track 204 via the fifth boss 356 and the third aperture 358. Similarly, in some examples, a fourth resilient portion 364 is disposed on the second arm 320 and includes the sixth boss 360, which may affect the above disclosed fourth threshold magnitude associated with enabling the second portion 202 of the first adjustable end frame 140 to unlock relative to and/or decouple from the first track 204 via the sixth boss 360 and the third aperture 358. As shown in FIG. 3A, the third resilient portion 362 is formed by a third recess (e.g., a U-shaped recess) 366 at least partially surrounding the fifth boss 356. The third recess 366 is disposed on the second arm 320 and extends therethrough to a central portion (e.g., a hollow portion) of the second arm 320. Similarly, as shown in FIG. 3A, the fourth resilient portion 364 is formed by a fourth recess 368 disposed on the second arm 320 and extending therethrough to the inner portion of the second arm 320.

In some examples, the example second portion 202 of the first adjustable end frame 140 includes one or more additional bosses (similar to the fifth boss 356 and/or sixth boss 360) to engage the first track 204. In such examples, the first track 204 includes a fourth aperture or groove 370 to receive a seventh boss or protrusion and/or an eighth boss or protrusion positioned on the second arm 320 opposite the fifth boss 356 and/or the sixth boss 360. As shown in FIG. 3A, the fourth aperture 370 is positioned on the inner surface 332 of the second wall 328 of the first track 204 opposite the third aperture 358.

In some examples, to retain the second portion 202 in the first track 204 and/or guide movement thereof, the example adjustment system 300 of FIGS. 3A-C includes a fifth rail 372 disposed on the second arm 320 of the second portion 202 of the first adjustable end frame 140. In the example of FIG. 3A, the fifth rail 372 extends along a length the second arm 320 to be received by and/or engage the first track 204. In particular, the fifth rail 372 is to extend into or through the first groove 336 (FIG. 3B) of the first wall 326 of first track 204, which limits and/or guides relative movement between the second portion 202 of the first adjustable end frame 140 and the first track 204.

In some examples, the example adjustment system 300 of FIGS. 3A-C includes a sixth rail disposed on the second arm 320, opposite the fifth rail 372, to engage the first track 204. In such examples, the sixth rail is to extend into or through the second groove 340 of the of the second wall 328 of the first track 204, which may better retain the second arm 320 in the first track 204 and/or further guide movement between the second arm 320 and the first track 204.

In some examples, to retain the second arm 320 in the first track 204, the example adjustment system 300 of FIG. 3A includes a third protrusion 374 disposed on the second arm 320 to be received by and/or engage the first track 204. The third protrusion 374 of FIG. 3A includes a shape that is substantially rectangular and extends away from the second arm 320. In other examples, the third protrusion 374 includes one or more other suitable shapes, such as a circle, a regular polygon (e.g., a square, a regular hexagon, etc.), an irregular polygon (e.g., a trapezoid, a rhombus, etc.), etc. In particular, the third protrusion 374 of FIG. 3A is to extend into or through the third groove 344 of the first wall 326 of the first track 204. In such examples, a range of movement of the second portion 202 of the first adjustable end frame 140 relative to the first track 204 is defined by the length of the third groove 344. For example, the third protrusion 374 of FIG. 3A engages the first end 346 of the third groove 344 to limit expansion of the first adjustable end frame 140 and/or prevent the second portion 202 from separating from the first track 204. Similarly, the third protrusion 374 engages the second end 348 of the third groove 344 to limit contraction of the first adjustable end frame 140.

In some examples, the example adjustment system 300 of FIGS. 3A-C similarly includes a fourth protrusion disposed on the first arm 310, opposite the third protrusion 374, to be received by and/or engage the first track 204. In such examples, the fourth protrusion is to extend into or through the fourth groove 350 of the second wall 328 of the first track 204 having the first end 352 associated with limiting expansion of the first adjustable end frame 140 and the second end 354, opposite the first end 352, associated with limiting contraction of the first adjustable end frame 140.

While FIGS. 3A-C depict the first adjustable end frame 140 implemented with the example adjustment system 300, in some examples, the second adjustable end frame 142 may likewise be implemented with the example adjustment system 300.

Figures 4A, 4B:
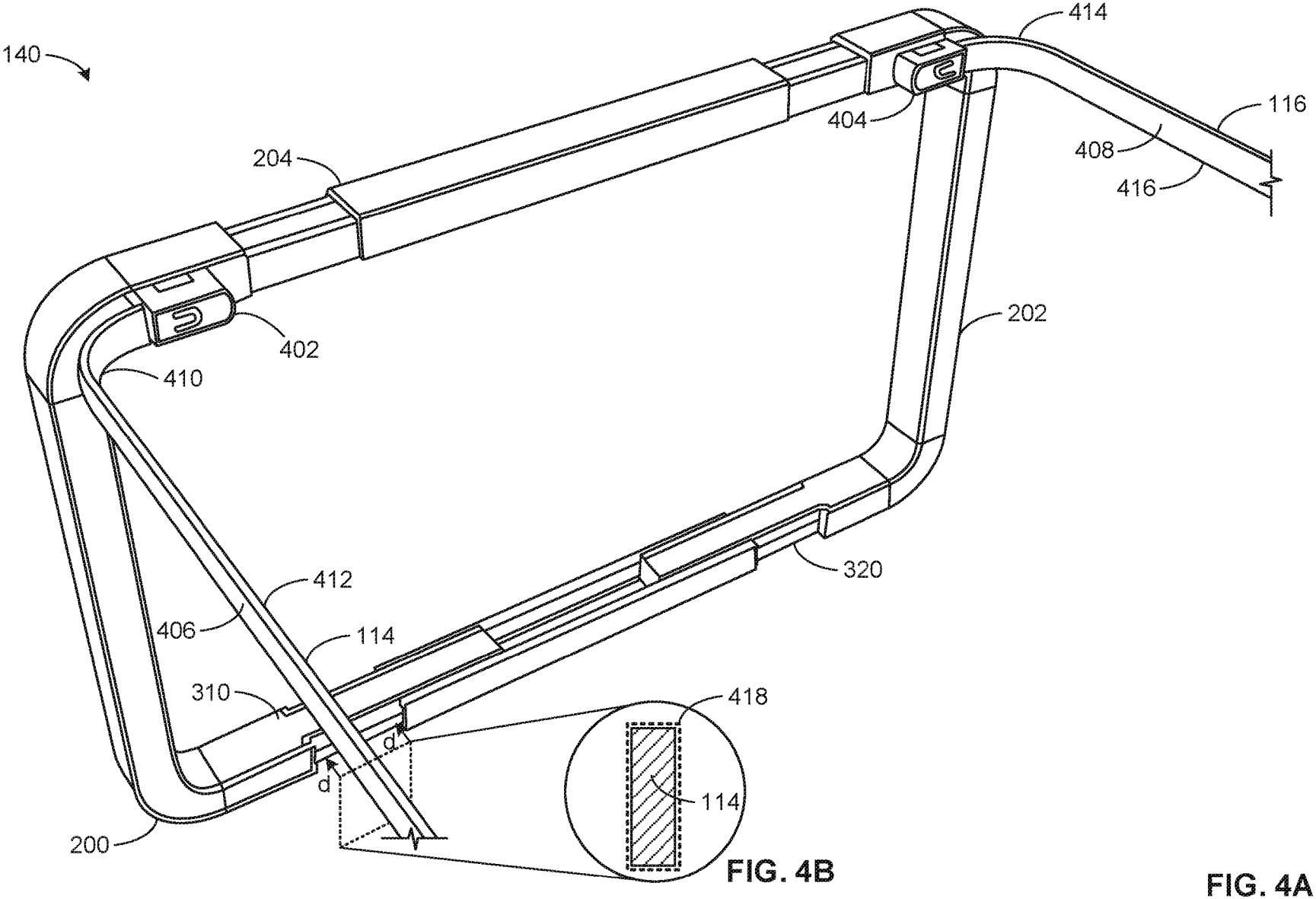
FIG. 4A is an isometric view of a portion of the example adjustable frame of FIG. 1 and shows example clips in accordance with examples disclosed herein.
FIG. 4B is a cross-sectional view of an example rail taken along the d-d line of FIG. 4A.

FIG. 4A is an isometric view of the first adjustable end frame 140 of FIG. 1 and shows the above disclosed first example clip 402 for coupling the first rail 114 to the first portion 200 of the first adjustable end frame 140. The first clip 402 of FIG. 4A is interposed between the first portion 200 of the first adjustable end frame 140 and the first rail 114. For example, the first clip 402 is coupled to the first arm 310 as well as the first rail 114, thereby fixing an orientation of the first rail 114 relative to the first arm 310. Similarly, in the example of FIG. 4A, a second example clip 404 for coupling the second rail 116 to the second portion 202 of the first adjustable end frame 140 is interposed therebetween. The second clip 404 of FIG. 4A is coupled to the second arm 320 as well as the second rail 116, thereby fixing an orientation of the second rail 116 relative to the second arm 320. As a result, when the first adjustable end frame 140 is implemented with the first clip 402 and the second clip 404, an orientation of the first rail 114 relative to the second rail 116 is maintained. In such examples, a first flat or level surface 406 of the first rail 114 at least partially defines a first plane that is substantially parallel relative to a second plane at least partially defined by a second flat or level surface 408 of the second rail 116. For example, an angle formed by the first plane and the second plane is between about −5 degrees and about 5 degrees. In other examples, the angle formed by the first plane and the second plane is greater than 5 degrees or less than −5 degrees.

In some examples, similar to the above disclosed first example clip 402 and the second example clip 404, the second adjustable end frame 142 may likewise be implemented with a third example clip 422 (shown in FIG. 4C) for coupling the first rail 114 thereto and/or a fourth example clip 424 (shown in FIG. 4C) for coupling the second rail 116 thereto, as disclosed further below in connection with FIG. 4C.

The first rail 114 of FIG. 4A includes a curved portion 410 extending through the first clip 402 and away relative to the first clip 402 and/or second rail 116. The first rail 114 of FIG. 4A also includes a straight portion 412 adjacent the curved portion 410 and extending away from the first clip 402 and/or parallel relative to the second rail 116 to receive at least a portion (e.g., the first hanger portion 124 and/or the third hanger portion 130) of each folder 104, 106, 108, 110. Similarly, the second rail 116 of FIG. 4A includes a curved portion 414 extending through the second clip 404 and away relative to the second clip 404 and/or the first rail 114. The second rail 116 of FIG. 4A also includes a straight portion 416 extending from the curved portion 414 away from the second clip 404 and/or parallel relative to the first rail 114 to receive at least a portion (e.g., the second hanger portion 126 and/or the fourth hanger portion 132) of each folder 104, 106, 108, 110.

As shown in FIG. 4B, the first rail 114 includes a cross-sectional shape that is substantially rectangular. As such, the first rail 114 also includes a contour 418 (as represented by the dotted/dashed lines in FIG. 4B) that is substantially rectangular. In such examples, the cross-sectional shape of the first rail 114 provides for an increased moment of inertia (e.g., an Area Moment of Inertia) of the first rail 114 that would otherwise be unattainable, for example, if the cross-sectional shape is circular, square, triangular, etc. and a constant cross-sectional area of the first rail 114 is maintained. As a result, by implementing the first rail 114 (and/or the second rail 116) with the rectangular cross-sectional shape, the first rail 114 may support a greater load while occupying less space and/or reducing weight or mass than experienced when the cross-sectional shape is square, triangular, etc. Similarly, in some examples, the second rail 116 likewise includes a cross-sectional shape that is substantially rectangular. In some examples, the first rail 114 and/or the second rail 116 include a cross-section having another suitable shape, such as a circle.

Figure 4C:
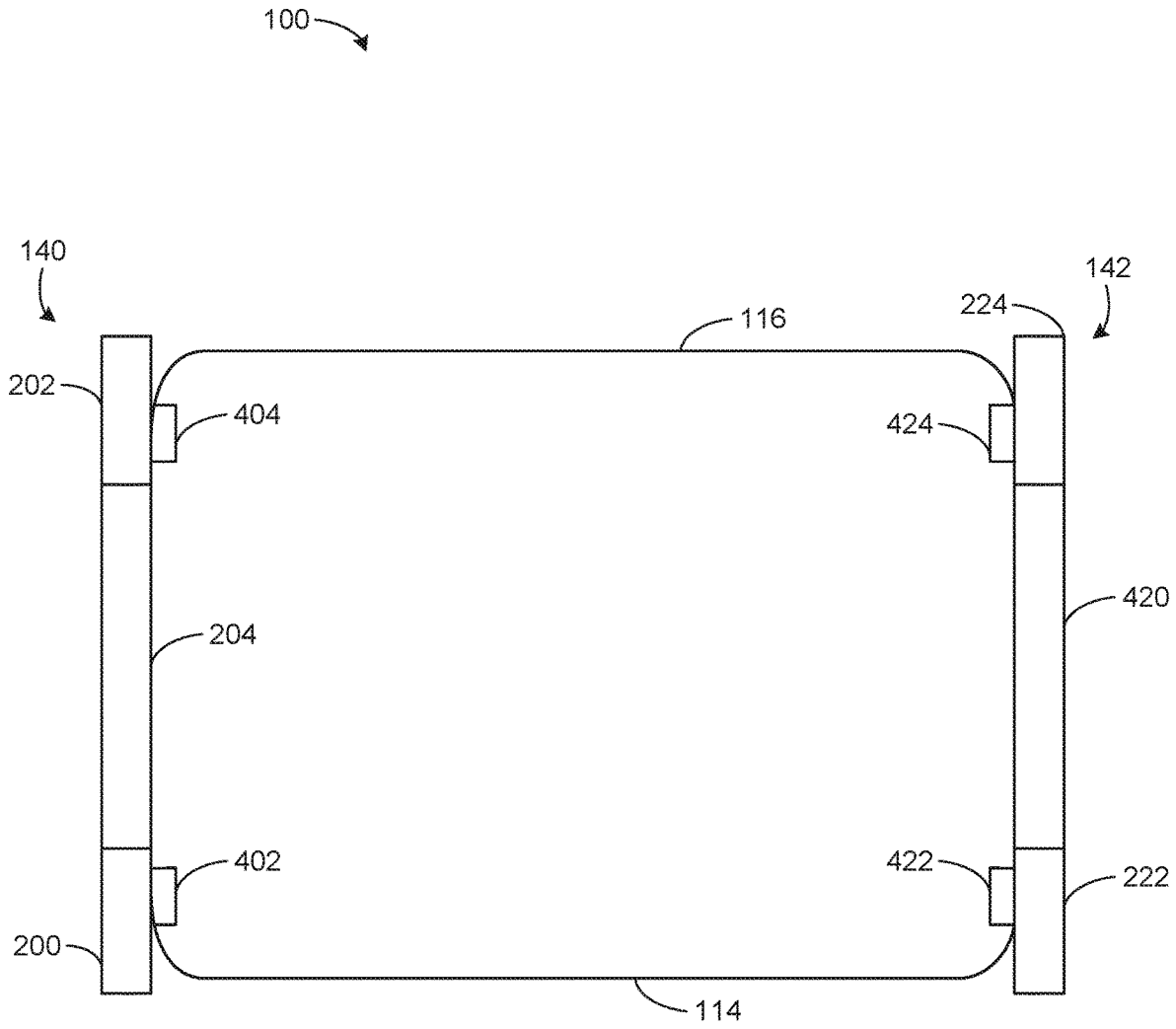
FIG. 4C is a top view of the example frame of FIG. 1.

FIG. 4C is a top-view of the adjustable frame assembly 100 of FIG. 1 and shows the first example rail 114 and the second example rail 116 coupled to both the first adjustable end frame 140 and the second adjustable end frame 142. As shown in FIG. 4C, the first portion 200 and the second portion 202 of the first adjustable end frame 140 are moveably coupled together via the first track 204, and the first portion 222 and the second portion 224 of the second adjustable end frame 142 are movably coupled together via the third track 420 disclosed above in connection with FIGS. 2A and 2B. In the example of FIG. 4C, the first example clip 402 is interposed between the first rail 114 and the first portion 200 of the first adjustable end frame 140, and the example second clip 404 is interposed between the second rail 116 and the second portion 202 of the first adjustable end frame 140. Further, in the example of FIG. 4C, the above disclosed third example clip 422 is interposed between the first rail 114 and the first portion 222 of the second adjustable end frame 142, and the above disclosed fourth example clip 424 is interposed between the second rail 116 and the second portion 224 of the second adjustable end frame 142. As such, the first rail 114 of FIG. 4C is coupled to the first adjustable end frame 140 via the first clip 402 and the second adjustable end frame 142 via the third clip 422, and the second rail 116 is coupled to the first adjustable end frame 140 via the second clip 404 and the second adjustable end frame 142 via the fourth clip 424.

In such examples, the first clip 402 and/or the second clip 404 facilitate assembly of the first adjustable end frame 140 with the first rail 114 and/or the second rail 116 as well as improve loading performance of the first adjustable end frame 140. Similarly, the third clip 422 and/or the fourth clip 424 of FIG. 4C facilitate assembly of the second adjustable end frame 142 with the first rail 114 and/or the second rail 116 as well as improve loading performance of the second adjustable end frame 142. For example, each of the clips 402, 404, 422, 424 may reduce and/or effectively distribute stress imparted on the first adjustable end frame 140 and/or the second adjustable end frame 142 by the rail(s) 114, 116, which enables the end frame(s) 140, 142 to support a greater load (e.g., a greater number of files or papers) that would otherwise be unattainable (e.g., if the rail(s) 114, 116 are directly coupled to the first adjustable end frame 140 and/or the second adjustable end frame 142). For example, one or more of the clips 402, 404, 422, 424 may have a substantially large mating surface area (e.g., compared to a mating surface area of the first rail 114 and/or the second rail 116) that engages the end frame(s) 140, 142. Further, such clips 402, 404, 422, 424 better maintain and/or fix an orientation of the first rail 114 relative to the second rail 116 as well as an orientation of the second rail 116 relative to the first rail 114 and, as a result, the folder(s) 104, 106, 108, 110, 112 hanging on the first rail 114 and the second rail 116 easily retain engagement thereto as well as slide and/or move along the rails 114, 116.

Figure 5:
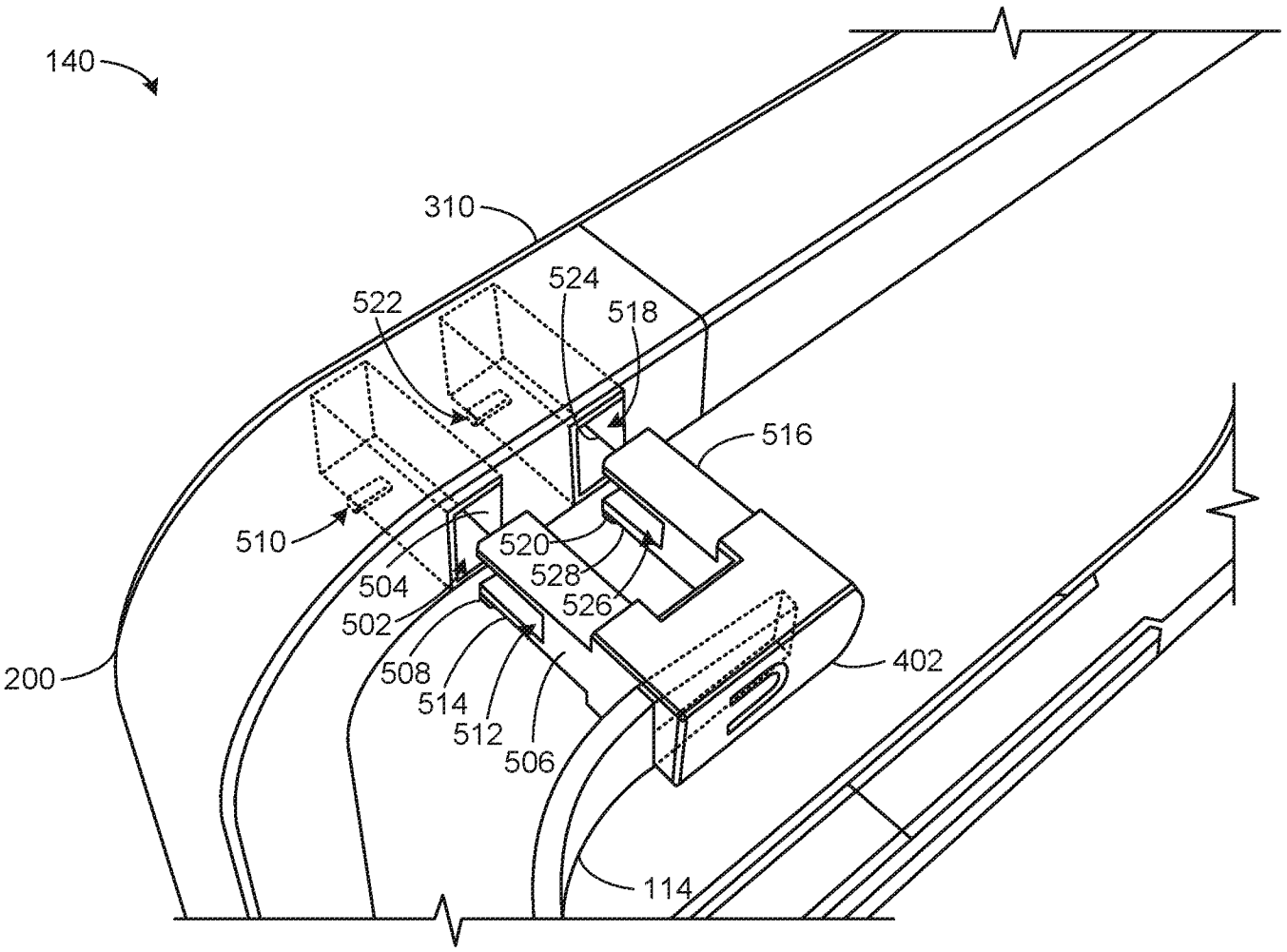
FIG. 5 is an enlarged view of a portion of the example adjustable frame of FIG. 1 and shows an example clip separated therefrom.

FIG. 5 is an enlarged view of a portion of the adjustable end frame 140 of FIG. 1 and shows the first example clip 402 of FIG. 4A separated therefrom. As shown in FIG. 5, the first rail 114 is coupled to and/or at least partially extends into or through the first clip 402. In some examples, to couple the first rail 114 to the first portion 200 of the first adjustable end frame 140 via the first clip 402, the first adjustable end frame 140 is implemented with one or more receptacles to receive the first clip 402. For example, the first portion 200 of the first adjustable end frame 140 includes a fifth aperture 502 (e.g., a first receptacle of the first portion 200 of the first adjustable end frame 140) extending at least partially therethrough. In the example of FIG. 5, the fifth aperture 502 defines an inner surface 504 to engage at least a portion of the first clip 402. In particular, the fifth aperture 502 and/or the inner surface 504 is/are shaped to engage one or more contours 622, 624 (shown in FIGS. 6B and 6C) of the portion of the first clip 402, which prevents the first clip 402 from moving relative to the first portion 200 of the first adjustable end frame 140 when coupled thereto as well as reduces stress imparted on the inner surface 504 by the first clip 402.

In some examples, the first clip 402 includes means for coupling the first clip 402 to the first portion 200 of the first adjustable end frame 140. As shown in FIG. 5, the first clip 402 includes a first extension 506 extending away from the first rail 114 to be received by the fifth aperture 502. In particular, the first extension 506 includes a fifth protrusion (e.g., a tooth) 508 to be received by a fifth groove 510 formed by the inner surface 504 of the fifth aperture 502 to retain the first clip 402 in the fifth aperture 502. For example, the fifth protrusion 508 engages a portion of the inner surface 504 defining the fifth groove 510, thereby coupling the first clip 402 and/or the first rail 114 to the first arm 310.

In some examples, to effectively retain the first clip 402 via the first extension 506, the fifth protrusion 508 extends to a particular depth in the fifth groove 510, which may prevent the fifth protrusion 508 from leaving the fifth groove 510 and/or disengaging from the inner surface 504 of the fifth aperture 502. In such examples, the first extension 506 and/or the fifth protrusion 508 of the first clip 402 is/are sized to be larger than the fifth aperture 502. As such, the first extension 506 compresses when passing through the fifth aperture 502 and decompresses when the fifth protrusion 508 is aligned to the fifth groove 510 to position the fifth protrusion 508 in the fifth groove 510. In some examples, to facilitate such compression and/or decompression of the first extension 506, a fifth recess 512 is disposed on the first extension 506 adjacent the fifth protrusion 508 to define a first resilient portion 514 of the first extension 506.

In some examples, similar to the first extension 506, the first clip 402 includes a second extension 516, adjacent and/or spaced from the first extension 506, extending away from the first rail 114 to be received by a sixth aperture 518 (e.g., a second receptacle of the first portion 200 of the first adjustable end frame 140) formed by the first arm 310. As shown in FIG. 5, the second extension 516 includes a sixth protrusion (e.g., a tooth) 520 to be received by a sixth groove 522 formed by an inner surface 524 of the sixth aperture 518. For example, the sixth protrusion 520 engages a portion of the inner surface 524 defining the sixth groove 522 when the sixth protrusion 520 is aligned to the sixth aperture 518. In such examples, the sixth protrusion 520 may extend to a particular depth in the sixth groove 522 to better retain the sixth protrusion 520 therein. In such examples, the second extension 516 and/or the sixth protrusion 520 of the first clip 402 is/are sized to be larger than the sixth aperture 518. As such, the second extension 516 compresses when passing through the sixth aperture 518 and decompresses when the sixth protrusion 520 is aligned to the sixth groove 522 to position the sixth protrusion 520 in the sixth groove 522. Further, in such examples, a sixth recess 526 is disposed on the second extension 516 adjacent the sixth protrusion 520 to define a second resilient portion 528 of the second extension 516, including the sixth protrusion 520, which facilitates compression and/or decompression of the second extension 516.

While FIG. 5 depicts the means for coupling the first clip 402 to the first portion 200 of the first adjustable end frame 140 to include one or more of the first extension 506, the fifth protrusion 508, the fifth groove 510, the second extension 516, the sixth protrusion 520, and/or the sixth groove 522, in other examples, the means for coupling includes one or more adhesives, screws, nuts, bolts, and/or any other suitable chemical and/or mechanical fastener or combination of fasteners. Further, while FIG. 4 depicts aspects in connection with the first example clip 402, in other examples, such aspects likewise apply to one or more other clips that may be implemented with the first adjustable end frame 140 and/or the second adjustable end frame 142 such as, for example, the second example clip 404, the third example clip 422, and/or the fourth example clip 424.

Figure 6A:
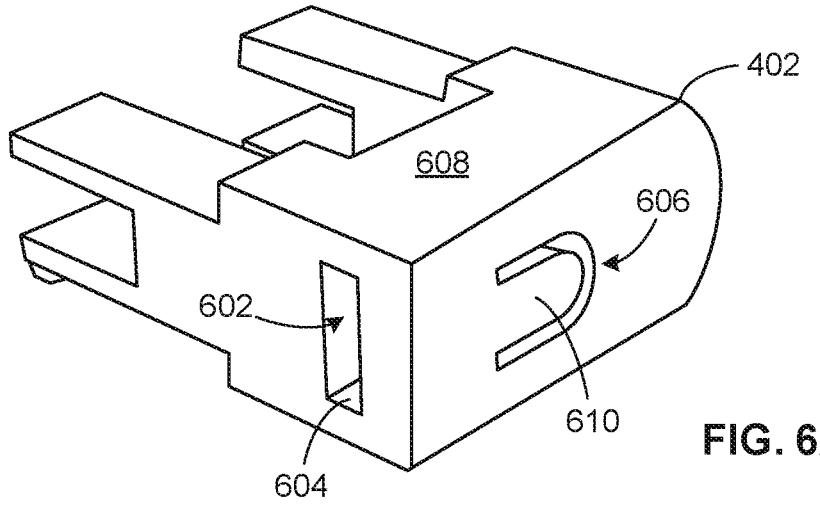
FIG. 6A is a perspective view of the example clip.
Figure 6B:
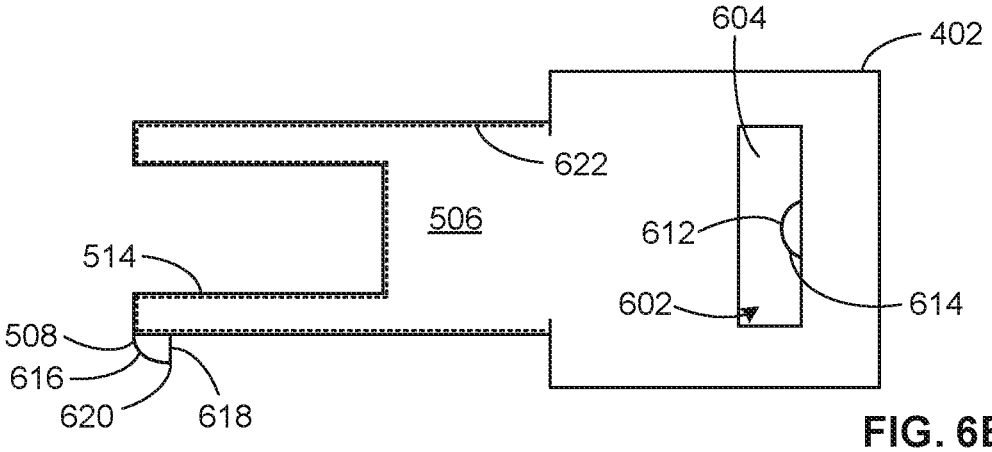
FIG. 6B is a side view of the example clip.
Figure 6C:
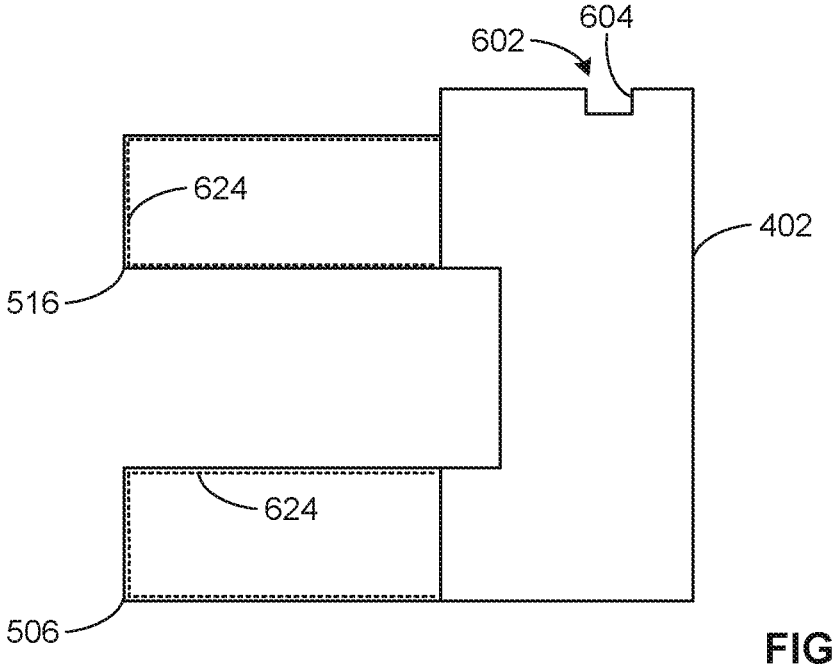
FIG. 6C is a top view of the example clip.

FIGS. 6A-C are detailed views of the first example clip 402 of FIGS. 4A and 4C. In particular, FIG. 6A is an isometric view of the first example clip 402, FIG. 6B is a side-view of the first example clip 402, and FIG. 6C is a top-view of the first example clip 402. In some examples, to receive a portion (e.g., the curved portion 410) of the first rail 114, the first example clip 402 is implemented with a receptacle. In the example of FIGS. 6A-C, a seventh aperture 602 (e.g., a first receptacle of the first clip 402) is disposed on the first clip 402 and at least partially extends therethrough. The seventh aperture 602 defines an inner surface 604 of the first clip 402 to engage the outer surface 406 of the first rail 114. In some examples, the inner surface 604 is shaped to engage the contour 418 of the first rail 114 to prevent the first rail 114 from tilting and/or rotating relative to the first clip 402 as well as reduce stress imparted on the inner surface 604 by the first rail 114.

In some examples, the first clip 402 includes means for coupling the first rail 114 thereto. For example, as shown in FIG. 6A, a fifth recess (e.g., a U-shaped recess) 606 is disposed on an outer surface 608 of the first clip 402 extending therethrough to the inner surface 604 to define a resilient portion 610 of the first clip 402. In particular, a portion of the inner surface 604 enclosed and/or surrounded by the fifth recess 606 engages (e.g., gradually engages) the first rail 114 when the first rail 114 passes through the seventh aperture 602, thereby coupling the first rail 144 to the first clip 402. In some examples, the resilient portion 610 and/or the inner surface 604 includes a ninth boss or protrusion 612 (FIG. 6B) to engage the first rail 114. As shown in FIG. 6B, the ninth boss 612 is positioned in the seventh aperture 602 to engage the first rail 114 when the first rail 114 passes through the seventh aperture 602. In the example of FIG. 6B, the ninth boss 612 includes a curved outer surface 614 to provide for gradual engagement of the first rail 114. In particular, the ninth boss 612 of FIG. 6B extends beyond the seventh aperture 602 to cause the ninth boss 612 to compress (e.g., cause the first resilient portion 610 of the first clip 402 to move away from the first rail 114) when the first rail 114 passes through the seventh aperture 602, thereby clamping the first rail 114 in the first clip 402. While FIGS. 6A and 6B depict the means for coupling the first rail 114 to the first clip 402 to include the inner surface 604, the first resilient portion 610, and/or the ninth boss 612, in other examples, the means for coupling includes one or more adhesives, screws, nuts, bolts, and/or any other suitable chemical and/or mechanical fastener or combination of fasteners.

In some examples, the means for coupling the first clip 402 to the first portion 200 of the first adjustable end frame 140 and the means for coupling one of the rails 114, 116 to the first clip 402 together ensure a proper orientation of the first rail 114 relative to the second rail 116 (or vice versa). For example, the fifth protrusion 508 only passes into and/or extends through the fifth groove 510 when the first clip 402 has a particular orientation relative to the first adjustable end frame 140 (e.g., when the seventh aperture 602 of the first clip 402 faces away from the second portion 202 of the first adjustable end frame 140 and/or the second clip 404). In such examples, the first clip 402 may not couple to the first portion 200 of the first adjustable end frame 140 when improperly oriented (e.g., when the seventh aperture 602 of the first clip 402 faces toward the second portion 202 of the first adjustable end frame 140 and/or the second clip 404), which may facilitate assembly of the first adjustable end frame 140 (and/or the second adjustable end frame 142) with at least one of the rails 114, 116 as well as one or more of the example clips 402, 404, 422, 424 by preventing user error.

In the example of FIG. 6B, a lower (in the orientation of FIG. 6B) portion of the first extension 506 of the first clip 402 includes the above disclosed fifth protrusion 508 formed on the first resilient portion 514. In particular, the fifth protrusion 508 of FIG. 6B includes a curved and/or an angled surface 616 and a flat surface 618, adjacent the angled surface 616, forming an edge 620 therebetween to engage the fifth groove 510 in the first arm 310. The curved and/or the angled surface 616 of FIG. 6B better enables the fifth protrusion 508 and/or first resilient portion 514 to move when the first extension 506 passes through the fifth aperture 502 of the first portion 200 of the first adjustable end frame 140. In some examples, although not shown, the sixth protrusion 520 formed on the second resilient portion 528 of the first clip 402 similarly includes one or more of a curved and/or an angled surface, a flat surface, and/or edge formed therebetween to engage the sixth groove 522.

The fifth protrusion 518, and similarly the sixth protrusion 520, support the first clip 402 in a locked engagement with the first portion 200. In some examples, the fifth protrusion 518 and/or sixth protrusion 520 may cause the first clip 402 to be permanently locked in the first portion 200 (i.e., the first clip 402 does not have a releasable and re-engageable connection with the first portion 200 and cannot be removed from the first portion 200 without causing damage to one or more components). In some examples, only one of the fifth protrusion 518 or the sixth protrusion 520 is needed to effect the permanent coupling of the first clip 402 and the first portion 200. Similar locking structures may be included between one or more of the second clip 404, the third clip 422 and/or the fourth clip 424 and respective second portion 202 of the first adjustable end frame 140, the first portion 222 of the second adjustable end frame 142, and the second portion 224 of the second adjustable end frame 142.

As shown in FIG. 6B, the first clip 402 includes the above disclosed first example contour 622 (as represented by the dotted/dashed lines of FIG. 6B). The first example contour 622 of FIG. 6B is defined by the first extension 506 and/or the second extension 516 of the first clip 402. As shown in FIG. 6C, the first clip 402 includes the above disclosed second example contour 624 (as represented by the dotted/dashed lines of FIG. 6C). The second example contour 624 of FIG. 6C is similarly defined by the first extension 506 and/or the second extension 516 of the first clip 402. In some examples, the first contour 622 and/or the second contour 624 may be shaped differently. For example, the first contour 622 is at least partially defined by the fifth protrusion 508 and/or the sixth protrusion 520, and/or the second contour 624 is at least partially defined by the fifth protrusion 508 and/or the sixth protrusion 520. In other examples, the first contour 622 and/or the second contour 624 is/are tapered.

While FIGS. 6A-C depict aspects in connection with the first example clip 402, in other examples, such aspects likewise apply to one or more other clips that may be implemented with the first adjustable end frame 140 and/or the second adjustable end frame 142 such as, for example, the second example clip 404, the third example clip 422, the fourth example clip 424, etc.

Figure 7B:
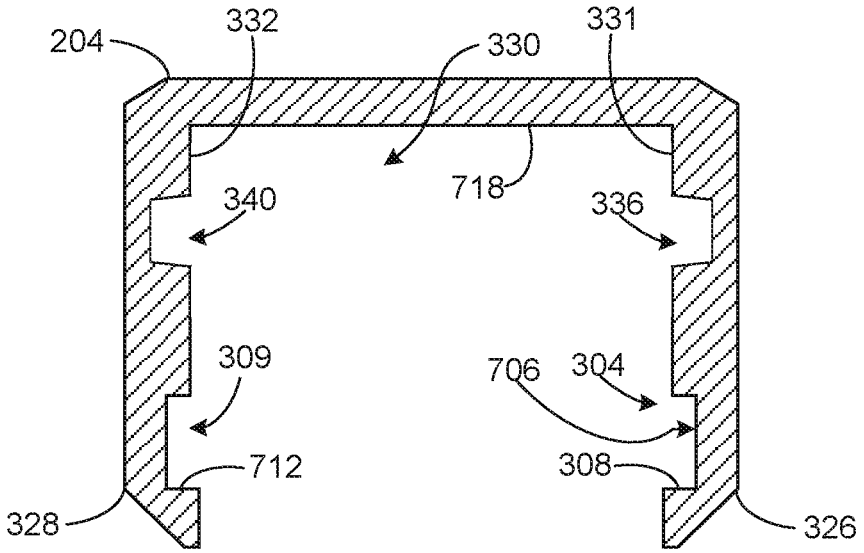
FIG. 7B is a cross-sectional view of an example track of FIG. 3A taken along the b-b line of FIG. 3A.

FIGS. 7A and 7B are cross-sectional views of the first example adjustable end frame 140 as well as the first example track 204. In particular, FIG. 7A is a cross-sectional view of the example first arm 310 of FIG. 3A taken along line a-a of FIGS. 3A and 3C and FIG. 7B is a cross-sectional view of the first track 204 of FIG. 3A taken along line b-b of FIGS. 3A and 3B. In some examples, as shown in FIG. 7A, the first boss 302 of the first arm 310 includes the above disclosed curved and/or angled outer surface 702 to engage the inner surface 308 (FIG. 7B) defined by the first aperture 304 of the first track 204. In such examples, the first threshold magnitude associated with the first boss 302 may be defined by one or more of the outer surface 702 of the first boss 302, the inner surface 308 of the first aperture 304, and/or a depth at which the first boss 302 extends into the first aperture 304. For example, the first threshold hold magnitude may decrease by reducing a distance 704 at which the first boss 302 extends from the first arm 310 and/or by reducing a depth 706 at which the first aperture 304 extends into the first wall 326.

As shown in FIG. 7A, the example first arm 310 of the first portion 200 of the first adjustable end frame 140 includes the third boss 708 disclosed above in connection with FIG. 3A. The third boss 708 of FIG. 7A is positioned on the first arm 310 opposite the first boss 302. Similar to the first boss 302, the third boss 708 of FIG. 7A likewise includes a curved and/or angled outer surface 710 to engage an inner surface 712 (FIG. 7B) defined by the second aperture 309 positioned on the first track 204. Further, in other examples, one or more of the other bosses of first adjustable end frame 140 and/or the second adjustable end frame 142 likewise include curved and/or angled surfaces to engage one or more of the first track 204, the second track 212, the third track 420, and/or the fourth track 223 to facilitate movement thereof.

As shown in FIG. 7A, the first recess 322 disclosed above in connection with FIGS. 3A and 3C is positioned adjacent and/or at least partially surrounds the first boss 302 and extends to the above disclosed cavity 714 within the first arm 310 to define the first resilient portion 324 of the first arm 310. Accordingly, in the example of FIG. 7A, the first arm 310 of the first adjustable end frame 140 is hollow, which provides for increased strength and/or rigidity as well as reduced weight of the first arm 310 that would otherwise be unattainable if the first arm 310 is solid. Similarly, in other examples, the second arm 320 of the first adjustable end frame 140 is hollow. However, in other examples, the first arm 310 and/or the second arm 320 may be solid. Further, as shown in FIG. 7A, the first arm 310 (and/or the second arm 320) includes the square cross-sectional shape that provides a significantly large and/or flat outer surface of the first adjustable end frame 140, which enables the first adjustable end frame 140 to support the folder(s) 104, 106, 108, 110, 112 as a free standing assembly without coupling to a support structure (e.g., a drawer wall of a file cabinet) via screws, nuts, bolts, adhesives, and/or any other mechanical and/or chemical fastener or combination of fasteners.

In some examples, the first arm 310 includes the above disclosed fourth rail 716 disposed opposite the third rail 334. In such examples, as shown in FIGS. 7A and 7B, the third rail 334 is to extend into or through the first groove 336 disposed on the first wall 326, and the fourth rail 716 is to extend into or through the second groove 340 disposed on the second wall 328. In some examples, first groove 336 and/or the second groove 340 include a cross-sectional shape that is tapered, which may facilitate positioning the rail(s) 334, 716 therein.

As previously disclosed, the first arm 310 and/or the second arm 320 are positioned in the space 330 of the first track 204 between the inner surface 331 of the first wall 326 and the inner surface 332 of the second wall 328. In some examples, a first example intermediate surface (e.g., a flat or level surface) 718 of the first track 204 is disposed adjacent the inner surface 331 of the first wall 326 and/or the inner surface 332 of the second wall 328. For example, as shown in FIG. 7B, the first intermediate surface 718 is disposed between the inner surface 331 of the first wall 326 and the inner surface 332 of the second wall 328. In particular, the inner surfaces 331, 332 cooperatively receive and/or engage the first arm 310 and/or the second arm 320 of the first adjustable end frame 140 with the first intermediate surface 718. For example, as shown in FIGS. 7A and 7B, at least a portion of the inner surface 331 of the first wall 326 of the first track 204 receives and/or engages at least a portion of a first outer surface (e.g., a flat or level surface) 720 of the first arm 310, at least a portion of the inner surface 332 of the second wall 328 of the first track 204 receives and/or engages at least a portion of a second surface (e.g., a flat or level surface) 722 of the first arm 310, and/or at least a portion of the first intermediate surface 718 of the first track 204 receives and/or engages at least a portion of a third outer surface (e.g., a flat or level surface) 724 of the first arm 310.

In the example of FIG. 7A, the third outer surface 724 of the first arm 310 is angled relative to the first outer surface 720 and/or the second outer surface 722. In some examples, at least a portion of the first outer surface 720 defines a first plane substantially perpendicular relative to a second plane defined by at least a portion of the third outer surface 724. For example, a first angle formed by the first plane and the second plane is between about 85 degrees and about 95 degrees. In other examples, the first angle formed by the first plane and the second plane is greater than 95 degrees or less than 85 degrees. Similarly, in the example of FIG. 7A, at least a portion of the second outer surface 722 of the first arm 310 defines a third plane substantially perpendicular relative to the second plane defined by the third outer surface 724. For example, a second angle formed by the third plane and the second plane is between about 85 degrees and about 95 degrees. In other examples, the second angle formed by the third plane and the second plane is greater than 95 degrees or less than 85 degrees. In some examples, the first plane defined by the first outer surface 720 is substantially parallel relative to the third plane define by the second outer surface 722. For example, a third angle formed by the first plane and the third plane is between about −5 degrees and about 5 degrees. Further, in other examples, the third angle formed by the first plane and the third plane is greater than 5 degrees or less than −5 degrees.

In some examples, the first intermediate surface 718 of the first track 204 is angled relative to the inner surface 331 of the first wall 326 and/or the inner surface 332 of the second wall 328. As shown in FIG. 7B, at least a portion of the inner surface 331 of the first wall 326 defines a fourth plane substantially perpendicular relative to a fifth plane defined by at least a portion of the first intermediate surface 718. For example, a fourth angle formed by the fourth plane and the fifth plane is between about 85 degrees and about 95 degrees. In other examples, the fourth angle formed by the fourth plane and the fifth plane is greater than 95 degrees or less than 85 degrees. Similarly, in some examples, at least a portion of the inner surface 332 of the second wall 328 defines a sixth plane substantially perpendicular relative to the fifth plane defined by the first intermediate surface 718. For example, a fifth angle formed by the sixth plane and the fifth plane is between about 85 degrees and about 95 degrees. In other examples, the fifth angle formed by the sixth plane and the fifth plane is greater than 95 degrees or less than 85 degrees. Further, in some examples, the fourth plane defined by the inner surface 331 of the first wall 331 is substantially parallel relative to the sixth plane define by the inner surface 332 of the second wall 328. For example, a sixth angle formed by the fourth plane and the sixth plane is between about −5 degrees and about 5 degrees. In other examples, the sixth angle formed by the fourth plane and the sixth plane is greater than 5 degrees or less than −5 degrees.

While the example of FIGS. 7A and 7B depict the first example track 204 having the three surfaces 331, 332, 718 to receive and/or engage the three outer surfaces 720, 722, 724 of the first arm 310 (and/or three similar outer surfaces of the second arm 320), in other examples, the first track 204 receives and/or engages additional or fewer surfaces of the first arm 310 (and/or the second arm 320). For example, a lower portion (in the orientation of FIG. 7B) of the first track 204 may include a second intermediate surface (e.g., positioned on the first wall 326 and/or the second wall 328), opposite and/or facing the first intermediate surface 718, to receive and/or engage a fourth outer surface 726 of the first arm 320 (and/or a similar outer surface of the second arm 320).

Figure 8:
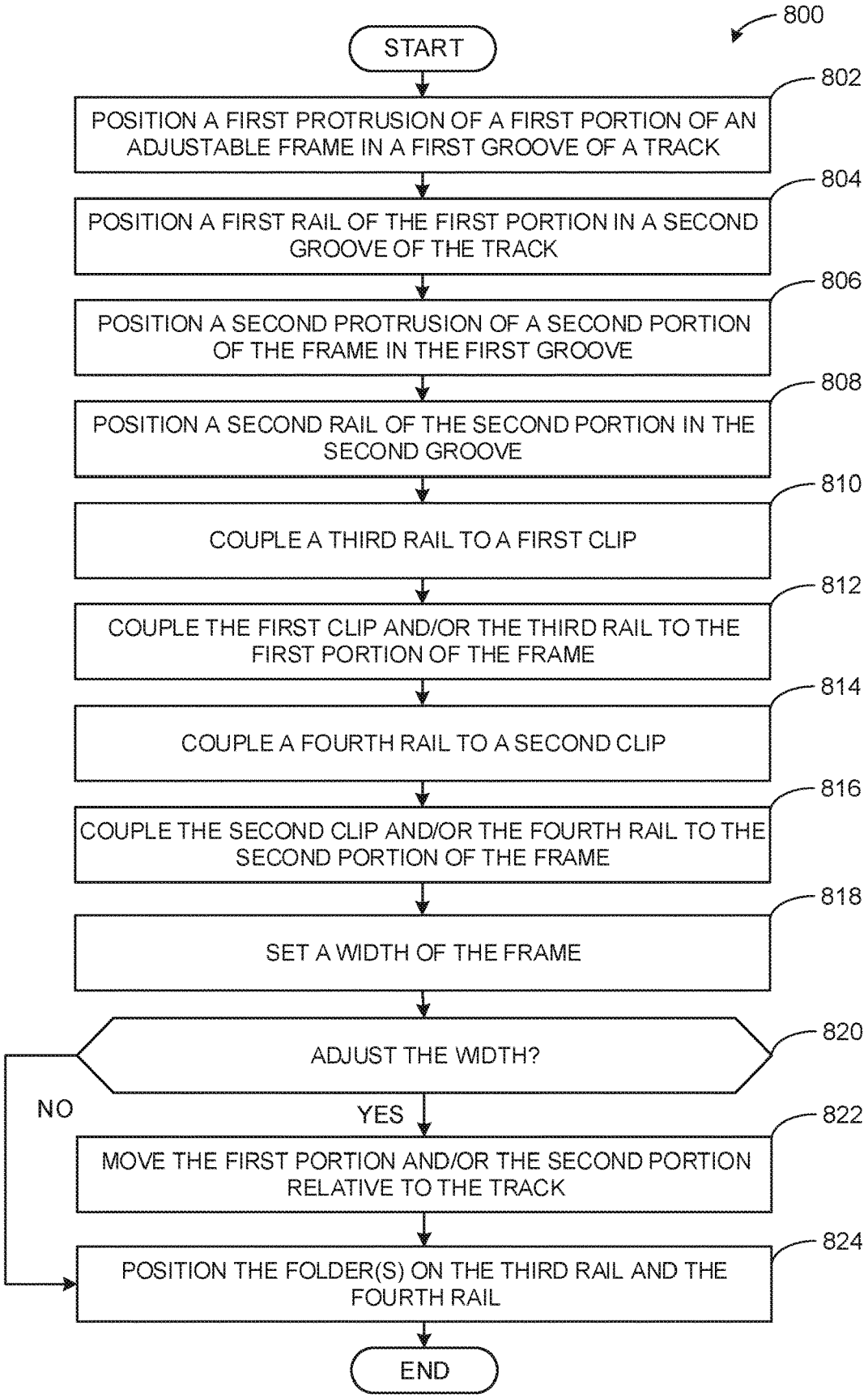
FIG. 8 is a flow chart showing instructions for assembling and adjusting the example adjustable frame of FIG. 1.

FIG. 8 is a flow diagram of an example method 800 that can be used to implement the first example adjustable end frame 140 and/or the second example adjustable end frame 142 of FIGS. 1, 2A, 2B, 3A-C, 4A-C, 5, 6A-C, 7A and/or 7B. The example method 800 may be implemented to support one or more of the example folders 104, 106, 108, 110, 112. The example method 800 begins by positioning a first protrusion of a first portion of an adjustable frame in a first groove of a track (block 802). In some examples, the first example protrusion 342 of the first example portion 200 of the first example adjustable end frame 140 of FIG. 3A is positioned in the third example groove 344 of the first example track 204. For example, the first protrusion 342 extends into or through the third groove 344 and/or engages the first track 204 (e.g., engages the first example end 346 and/or the second example end 348 of the third groove 344), which prevents the first portion 200 of the first adjustable end frame 140 from separating from the first track 204. Additionally or alternatively, in some examples, the second example protrusion of the first portion 200 of the first adjustable end frame 140 of FIG. 3A is similarly positioned in the fourth example groove 350 of the first example track 204. The example method 800 also includes positioning a first rail of the first portion in a second groove of the track (block 804). In some examples, the third example rail 334 of the first example portion 200 of the first example adjustable end frame 140 of FIGS. 3A, 3C and 7A is positioned in the first example groove 336 of the first track 204. For example, the third rail 334 extends into or through first groove 336 and/or engages the first track 204, which may guide movement of the first portion 200 of the first adjustable end frame 140 relative to the first track 204 and/or retain the first portion 200 in the space 330 defined between the first example wall 326 and the second example wall 328 of the first track 204. Additionally or alternatively, in some examples, the fourth example rail 716 of the first portion 200 of the first adjustable end frame 140 of FIGS. 3A and 7A is similarly positioned in the second example groove 340 of the first track 204.

The example method 800 also includes positioning a second protrusion of a second portion of an adjustable frame in the first groove (block 806). In some examples, the third example protrusion 374 of the second example portion 202 of the first example adjustable end frame 140 of FIG. 3A is positioned in the third example groove 344 of the first example track 204. For example, the third protrusion 374 extends into or through the third groove 344 and/or engages the first track 204 (e.g., engages the first example end 346 and/or the second example end 348 of the third groove 344), which prevents the second portion 202 of the first adjustable end frame 140 from separating from the first track 204. Additionally or alternatively, in some examples, the fourth example protrusion of the second portion 202 of the first adjustable end frame 140 of FIG. 3A is similarly positioned in the fourth example groove 350 of the first example track 204.

The example method 800 also includes positioning a second rail of the second portion in the second groove (block 808). In some examples, the fifth example rail 372 of the second example portion 202 of the first example adjustable end frame 140 of FIG. 3A is positioned in the first example groove 336 of the first track 204. For example, the fifth rail 372 extends into or through first groove 336 and/or engages the first track 204, which may guide movement of the second portion 202 of the first adjustable end frame 140 relative to the first track 204 and/or retain the second portion 202 in the space 330 defined between the first example wall 326 and the second example wall 328 of the first track 204. Additionally or alternatively, in some examples, the sixth example rail of the second portion 202 of the first adjustable end frame 140 is similarly positioned in the second groove 340 of the first track 204.

The example method 800 also includes coupling a third rail to a first clip (block 810). In some examples, the first example rail 114 of FIGS. 1, 2A, 2B, 3A, 4A-C, and 5 couples to the first example clip 402. For example, the example curved portion 410 of the first rail 114 extends into or through the seventh aperture 602 of the first clip 402 (e.g., the receptacle of the first clip 402). In such examples, the ninth example boss 612 engages (e.g., gradually engages) the first rail 114 when the first rail 114 passes through seventh aperture 602, thereby coupling the first rail 114 to the first clip 402.

The example method 800 also includes coupling the first clip and/or the third rail to the first portion of the frame (block 812). In some examples, the first example clip 402 of FIGS. 4A, 4C, 5, and 6A-C couples to the first example portion 200 of the first example adjustable end frame 140. For example, the first example extension 506 of the first clip 402 is positioned in the fifth aperture 502 of the first portion 200 of the first adjustable end frame 140 (e.g., positioned in the first receptacle of the first adjustable end frame 140). In particular, the fifth protrusion 508 positioned on the first extension 506 extends into or through the fifth example groove 510 formed by the inner surface 504 of the fifth aperture 502 and/or engages the inner surface 504 when the fifth protrusion 508 aligns to the fifth groove 510, thereby coupling the first clip 402 and/or the first rail 114 to the first portion 200 of the first adjustable end frame 140.

Further, in some examples, the second example extension 516 of the first clip 402 is similarly positioned in the sixth aperture 518 of the first portion 200 of the first adjustable end frame 140 (e.g., positioned in the second receptacle of the first adjustable end frame 140). In particular, the sixth protrusion 520 positioned on the second extension 516 extends into or through the sixth example groove 522 formed by the inner surface 524 of the sixth aperture 518 and/or engages the inner surface 524 when the sixth protrusion 520 aligns to the sixth groove 522.

The example method 800 also includes coupling a fourth rail to a second clip (block 814). In some examples, the second example rail 116 of FIGS. 1, 2A, 2B, 3A, 4A-C, and 5 couples to the second example clip 404. For example, similar to the first rail 114 and the first clip 402, the example curved portion 414 of the second rail 116 extends into or through the second clip 404 (e.g., via an aperture disposed on the second clip 404).

The example method 800 also includes coupling the second clip and/or the fourth rail to the second portion of the frame (block 816). In some examples, the second example clip 404 of FIGS. 4A, 4C, 5, and 6A-C couples to the second example portion 202 of the first example adjustable end frame 140. For example, similar to the first clip 402, one or more extensions of the second clip 404 is/are likewise positioned in one or more receptacles of the second portion 202 of the first adjustable end frame 140, thereby enabling the means for coupling the second clip 404 to the first adjustable frame 140.

The example method 800 also includes setting a width of the frame (block 818). In some examples, the first example track 204 of FIGS. 2A, 2B, 3A, 3B, 4A, 4C, 5, and 7B couples to the first example portion 200 and/or the second example portion 202 of the first example adjustable end frame 140, for example, to provide the above disclosed contracted position (shown in FIG. 2A) and/or the expanded position (shown in FIG. 2B) of the first adjustable end frame 140. For example, the first example boss 302 may extend into or through the first example aperture 304 to at least partially define the contracted position of the first adjustable end frame 140, and/or the second example boss 306 may extend into or through the first aperture 304 to at least partially define the expanded position of the first adjustable end frame 140. Similarly, in some examples, the fifth example boss 356 extends into or through the third example aperture 358 to at least partially define the expanded position of the first adjustable end frame 140, and/or the sixth example boss 360 extends into or through the third aperture 358 to at least partially define the expanded position of the first adjustable end frame 140.

The example method 800 also includes determining whether to adjust the width of the frame (block 820). In some examples, if the width of the first example adjustable end frame 140 of FIGS. 1, 2A, 2B, 3A-C, 4A-C, 5, 6A-C, 7A, and 7B is not to be adjusted (e.g., the distance 206 between the rails 114, 116 substantially corresponds to a size of the folder(s) 104, 106, 108, 110, 112), the example method 800 proceeds to positioning one or more of the folder(s) 104, 106, 108, 110, 112 on the rails 114, 116, as disclosed in further detail below in connection with block 824.

In some examples, if the width of the first example adjustable end frame 140 is to be adjusted (e.g., the distance 206 between the rails 114, 116 does not correspond to a size of the folder(s) 104, 106, 108, 110, 112), the example method 800 includes moving the first portion and/or the second portion relative to the track (block 822). In some such examples, as disclosed above, the first example adjustable end frame 140 of FIGS. 1, 2A, 2B, 3A-C, 4A-C, 5, 6A-C, 7A, and 7B is moveable between the contracted position (shown in FIG. 2A) and the expanded position (shown in FIG. 2B), for example, where the contracted position is associated with a first size (e.g., letter sized paper) and the expanded position is associated with a second size (e.g., legal sized paper). For example, to at least partially move the first adjustable frame 140 from the contracted position to the expanded position, a force (e.g., generated by a person) is provided to and/or imparted on the first portion 200 directed substantially in the first direction 208 away from the second portion 202. Additionally or alternatively, in some examples, to at least partially move the first adjustable frame 140 from the contracted position to the expanded position, a force is provided to and/or imparted on the second portion 202 directed substantially in the second direction 210 away from the first portion 200.

In some examples, to at least partially move the first adjustable frame 140 from the expanded position to the contracted position, a force is provided to and/or imparted on the first portion 200 directed substantially in the second direction 210 toward the second portion 202. Additionally or alternatively, in some examples, to at least partially move the first adjustable frame 140 from the expanded position to the contracted position, a force is provided to and/or imparted on the second portion 202 directed substantially in the first direction 208 toward the first portion 200.

In some examples, to facilitate adjustment between different positions, the first example adjustable end frame 140 is implemented with the above disclosed adjustment system 300, which provides for pre-defined positions of the first adjustable end frame 140. For example, the first example boss 302 extends into or through the first aperture 304 of the first track 204 when the first portion 200 of the first adjustable end frame 140 moves relative to the first track 204 (e.g., when the first boss 302 slides against the inner surface 331 of the first wall 326), thereby coupling the first portion 200 to the first track 204 and/or at least partially defining the contracted position of the first adjustable end frame 140. In such examples, to decouple the first portion 200 of the first adjustable end frame 140 from the first track 204 when in the contracted position, a force is provided to and/or imparted on the first portion 200 directed in the first direction 208 having a magnitude greater than the first threshold magnitude associated with the first boss 302 and/or the first aperture 304.

Further, in another example, the second example boss 306 similarly extends into or through the first aperture 304 of the first track 204 when the first portion 200 of the first adjustable end frame 140 moves relative to the first track 204 (e.g., when the second boss 306 slides against the inner surface 331 of the first wall 326), thereby coupling the first portion 200 to first track 204 and/or at least partially defining the expanded position of the first adjustable end frame 140. In such examples, to decouple the first portion 200 of the first adjustable end frame 140 from the first track 204 when in the expanded position, a force is provided to and/or imparted on the first portion 200 directed in the second direction 210 having a magnitude greater than the second threshold magnitude associated with the second boss 306 and/or the first aperture 304.

Additionally or alternatively, in some examples, the fifth example boss 356 extends into or through the third example aperture 358 of the first track 204 when the second portion 202 of the first adjustable end frame 140 moves relative to the first track 204 (e.g., when the fifth boss 356 slides against the inner surface 331 of the first wall 326), thereby coupling the second portion 202 to the first track 204 and/or at least partially defining the contracted position of the first adjustable end frame 140. In such examples, to decouple the second portion 202 of the first adjustable end frame 140 from the first track 204 when in the contracted position, a force is provided to and/or imparted on the second portion 202 directed in the second direction 210 having a magnitude greater than the third threshold magnitude associated with the fifth boss 356 and/or the third aperture 358.

In another example, the sixth example boss 360 similarly extends into or through the third aperture 358 of the first track 204 when the second portion 202 of the first adjustable end frame 140 moves relative to the first track 204 (e.g., when the sixth boss 360 slides against the inner surface 331 of the first wall 326), thereby coupling the second portion 202 to the first track 204 and/or at least partially defining the expanded position of the first adjustable end frame 140. In such examples, to decouple the second portion 202 of the first adjustable end frame 140 from the first track 204 when in the expanded position, a force is provided to and/or imparted on the second portion 202 directed in the first direction 208 having a magnitude greater than the fourth threshold magnitude associated with the sixth boss 360 and/or the third aperture 358.

In some examples, as disclosed above in connection with block 820, the example method 800 includes positioning the folder(s) on the third rail and the fourth rail (block 824). In such examples, one or more of the folder(s) 104, 106, 108, 110, 112, of FIG. 1 is/are positioned on the first example rail 114 and the second example rail 116 (e.g., after the rails 114, 116 are coupled to the first example adjustable end frame 140 via the first clip 402 and/or the second clip 404). For example, the first hanger portion or hook 124 and the third hanger portion or hook 130 of the first example folder 104 cooperatively engage the first rail 114. Similarly, the second hanger portion or hook 126 and the fourth hanger portion or hook 132 cooperatively engage the second rail 116. In this manner, the folder(s) 104, 106, 108, 110, 112 easily move on the rails 114, 116. As such, the first adjustable end frame 140 supports the folder(s) 104, 106, 108, 110, 112 and/or elevates the folder(s) 104, 106, 108, 110, 112 relative to the surface 102 on which the first adjustable end frame 140 is positioned.

Although the first example adjustable frame 140 and/or the second example adjustable end frame 142 is described with reference to the flowchart illustrated in FIG. 8, any other method of implementing the first adjustable end frame 140 and/or the second adjustable end frame 142 may alternatively be used. For example, the order of execution of the blocks of FIG. 8 may be combined and/or some of the blocks described may be changed, eliminated, or additional blocks may be added. The example method 800 shown in FIG. 8 is only one example method describing the implementation of the first adjustable end frame 140 and/or the second frame.

"Including" and "comprising" (and all forms and tenses thereof) are used herein to be open ended terms. Thus, whenever a claim lists anything following any form of "include" or "comprise" (e.g., comprises, includes, comprising, including, etc.), it is to be understood that additional elements, terms, etc. may be present without falling outside the scope of the corresponding claim. As used herein, when the phrase "at least" is used as the transition term in a preamble of a claim, it is open-ended in the same manner as the term "comprising" and "including" are open ended.

From the foregoing, it will be appreciated that adjustable frames for use with hanging folders and related methods are disclosed. Examples disclosed provide an example adjustable frame easily moveable between different positions (e.g., when implemented in a file cabinet) in accordance with different paper sizes (e.g., letter, legal, etc.), which enables a person to support differently sized folders without dissembling the example frame and/or replacing the example frame with a differently sized frame. In some examples, the example frame supports the folder(s) without coupling to a support structure (e.g., a drawer wall of a file cabinet) via screws, nuts, bolts, adhesives, and/or any other mechanical and/or chemical fastener or combination of fasteners. Examples disclosed herein enable the person to easily adjust the example frame between the different positions. As a result, examples disclosed herein reduce labor and/or costs associated with the above noted known frames for hanging folders.

Example apparatus, systems, and methods for adjustable file folder frames are disclosed herein. Further examples and combinations thereof include the following.

Example 1 is an apparatus that includes an adjustable frame for hanging folders. The frame is to couple to a first rail and a second rail spaced relative to each other to cooperatively receive a first folder. The frame is movable between an expanded position and a contracted position to enable the first and second rails to receive a second folder sized differently relative to the first folder. The apparatus of Example 1 also includes a receptacle disposed on the frame to receive a first clip for coupling the first rail to the frame.

Example 2 includes the apparatus of Example 1, wherein the receptacle includes an inner surface defining a groove to receive and retain a portion of the first clip.

Example 3 includes the apparatus of Example 1, wherein the frame includes a first portion movably coupled to a second portion via a track to facilitate movement thereof, wherein the first portion is proximate to the second portion when the frame is in the contracted position, and wherein the first portion is substantially spaced from the second portion when the frame is in the expanded position.

Example 4 includes the apparatus of Example 3, wherein the frame includes a protrusion positioned on the first portion to extend into a groove disposed on a wall of the track, the protrusion to engage an end of the groove to prevent the first portion from separating from the track.

Example 5 includes the apparatus of Example 1, wherein the frame includes a first arm having the receptacle disposed thereon, the arm extending away from the receptacle in a first direction toward a surface on which the frame is positioned to elevate the first rail.

Example 6 includes the apparatus of Example 5, wherein the first arm extends away from the receptacle in a second direction toward a second arm of the frame moveable relative to the first arm, the second arm to receive a second clip for coupling the second rail to the frame.

Example 7 includes the apparatus of Example 6, wherein at least one of the first arm or the second arm is hollow.

Example 8 includes the apparatus of Example 1, wherein the first clip is permanently coupled in the receptacle on the frame.

Example 9 is an apparatus for hanging folders that includes a frame having a first portion movable relative to a second portion, the first portion to receive a first rail and the second portion to receive a second rail to support a folder. The apparatus of Example 9 also includes a track interposed between at least a portion of the first portion and at least a portion the second portion to guide movement thereof. The track includes a first wall, a second wall, and an intermediate surface positioned therebetween to cooperatively receive at least a portion of an outer surface of the first portion and an outer surface of the second portion. In addition, the track is slidably coupled to the first portion and the second portion to define an expanded position and a contracted position of the frame.

Example 10 includes the apparatus of Example 9, wherein the first wall includes an aperture to receive a first boss and a second boss positioned on the first portion of the frame, the first boss associated with the expanded position and the second boss associated with the contracted position.

Example 11 includes the apparatus of Example 10, wherein the first boss or the second boss moves out of the aperture in response to a force imparted on the first portion of the frame, the force directed toward or away from the second portion.

Example 12 includes the apparatus of Example 9, wherein the first wall includes a groove to receive a third rail disposed on the first portion of the frame to retain the first portion between first wall and the second wall.

Example 13 includes the apparatus of Example 9, wherein the first wall includes a groove to receive a protrusion disposed on the first portion, the protrusion to engage an end of the groove to prevent the first portion from separating from the track.

Example 14 is an apparatus to hang folders that includes a first rail coupled to an adjustable frame for hanging folders, the first rail to receive a portion of a folder supported between the first rail and a second rail coupled to the frame. The frame is moveable between an expanded position and a contracted position to change a distance between the first and second rails corresponding to a size of the folder. The apparatus of Example 14 also includes a clip interposed between the frame and the first rail to fix an orientation of the first rail relative to the second rail.

Example 15 includes the apparatus of Example 14, wherein the first rail includes a curved portion coupled to the clip and a straight portion extending away from the clip.

Example 16 includes the apparatus of Example 14, wherein the clip includes a receptacle defining an inner surface shaped to engage a contour the first rail.

Example 17 includes the apparatus of Example 14, wherein the clip includes a portion extending into a receptacle positioned on the frame.

Example 18 includes the apparatus of Example 17, wherein the portion of the clip includes a protrusion positioned in a groove formed by an inner surface of the receptacle to couple the clip to the frame.

Example 19 includes the apparatus of Example 18, wherein the portion of the clip is sized to compress when passing through the receptacle and decompress when the protrusion is aligned to the groove to position the protrusion therein.

Example 20 includes the apparatus of Example 19, wherein the clip includes a recess disposed adjacent the protrusion to define a resilient portion of the clip to facilitate movement of the protrusion.

Example 21 is a method to adjust a frame for hanging folders. The method includes positioning a track between a first portion and a second portion of the frame, the first portion and the second portion extending between a first wall and a second wall of the track. The method also includes positioning one of a first rail or a first protrusion of the first portion in a groove of the first wall. The method also includes positioning one of a second rail or a second protrusion of the second portion in the groove. The method also includes moving the first portion relative to the second portion in accordance with a size of a folder.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An apparatus comprising:

a first rail including a first curved portion;

a second rail including a second curved portion;

an adjustable frame for hanging folders, wherein the frame is movable between an expanded position with the first rail and the second rail separated a first distance to receive a first folder and a contracted position with the first rail and the second rail separated a second distance to receive a second folder sized differently relative to the first folder, the frame including:

a first portion to receive the first rail;

a second portion to receive the second rail;

a track interposed between at least a portion of the first portion and at least a portion of the second portion, wherein the track includes a first wall, a second wall, and an intermediate surface positioned therebetween to cooperatively receive at least a portion of an outer surface of the first portion and at least a portion of an outer surface of the second portion, wherein the track is slidably coupled to the first portion and the second portion to define the expanded position and the contracted position; and a receptacle; and a clip for coupling the first rail to the frame, the clip disposed at the first curved portion, the clip including a portion extending into the receptacle, the portion including a protrusion to be positioned in a groove formed by an inner surface of the receptacle to couple the clip to the frame.

2. The apparatus of claim 1, wherein the first portion is proximate to the second portion when the frame is in the contracted position, and wherein the first portion is substantially spaced from the second portion when the frame is in the expanded position.

3. The apparatus of claim 1, wherein the groove is a first groove and the protrusion is a first protrusion, and wherein the frame includes a second protrusion positioned on the first portion to extend into a second groove disposed on the first wall of the track or the second wall of the track, the second protrusion to engage an end of the second groove to prevent the first portion from separating from the track.

4. The apparatus of claim 1, wherein the frame includes a first arm having the receptacle disposed thereon, the first arm extending away from the receptacle in a first direction toward a surface on which the frame is positioned to elevate the first rail.

5. The apparatus of claim 4, wherein the clip is a first clip, and wherein the first arm extends away from the receptacle in a second direction toward a second arm of the frame moveable relative to the first arm, the second arm to receive a second clip for coupling the second rail to the frame.

6. The apparatus of claim 5, wherein at least one of the first arm or the second arm is hollow.

7. The apparatus of claim 1, wherein the clip is permanently coupled in the receptacle on the frame.

8. An apparatus comprising:

an adjustable frame for hanging folders, the frame to couple to a first rail and a second rail spaced relative to each other to cooperatively receive a first folder, wherein the frame is movable between an expanded position and a contracted position to enable the first and second rails to receive a second folder sized differently relative to the first folder, the frame including:

a first end frame having a first portion movable relative to a second portion, the first portion to receive the first rail and the second portion to receive the second rail;

a second end frame to receive the first rail and the second rail;

a track interposed between at least a portion of the first portion and at least a portion of the second portion to guide movement thereof, wherein the track includes a first wall, a second wall, and an intermediate surface positioned therebetween to cooperatively receive at least a portion of an outer surface of the first portion and at least a portion of an outer surface of the second portion, wherein the track is slidably coupled to the first portion and the second portion to define an expanded position and a contracted position of the first end frame; and a receptacle; and a clip for coupling the first rail to the first end frame, the clip including a portion extending into the receptacle, the portion including a protrusion to be positioned in a groove formed by an inner surface of the receptacle to couple the clip to the first end frame.

9. The apparatus of claim 8, wherein the first wall includes an aperture to receive a first boss and a second boss positioned on the first portion of the frame, the first boss associated with the expanded position and the second boss associated with the contracted position.

10. The apparatus of claim 9, wherein the first boss or the second boss moves out of the aperture in response to a force imparted on the first portion of the first end frame, the force directed toward or away from the second portion.

11. The apparatus of claim 8, wherein the groove is a first groove, and wherein the first wall includes a second groove to receive a third rail disposed on the first portion of the first end frame to retain the first portion between first wall and the second wall.

12. The apparatus of claim 8, wherein the groove is a first groove and the protrusion is a first protrusion, and wherein the first wall includes a second groove to receive a second protrusion disposed on the first portion, the second protrusion to engage an end of the second groove to prevent the first portion from separating from the track.

13. An apparatus to hang folders, comprising:

a first end frame;

a second end frame;

a first rail coupled to the first end frame for hanging a plurality of folders on the first rail, the first rail to receive a portion of a folder supported between the first rail and a second rail coupled to the first end frame, wherein the first end frame is moveable between an expanded position and a contracted position to change a distance between the first and second rails associated with a width of the folder, the plurality of the folders to hang parallel to the first end frame and the second end frame;

the first end frame including:

a first portion to receive the first rail;

a second portion to receive the second rail;

a track interposed between the first portion and the second portion, the track including a first wall, a second wall, and an intermediate surface positioned therebetween, the track to receive at least a portion of an outer surface of the first portion and at least a portion of an outer surface of the second portion, and the track and the first portion slidably engaged and the track and the second portion slidably engaged to define the expanded position and the contracted position; and a receptacle; and a clip interposed between the first end frame and the first rail to fix an orientation of the first rail relative to the second rail, wherein the clip includes a portion extending into the receptacle, wherein the portion of the clip includes a protrusion positioned in a groove formed by an inner surface of the receptacle to couple the clip to the first end frame.

14. The apparatus of claim 13, wherein the clip includes a receptacle defining an inner surface shaped to engage a contour the first rail.

15. The apparatus of claim 13, wherein the portion of the clip is sized to compress when passing through the receptacle and decompress when the protrusion is aligned to the groove to position the protrusion therein.

16. The apparatus of claim 15, wherein the clip includes a recess disposed adjacent the protrusion to define a resilient portion of the clip to facilitate movement of the protrusion.

17. An apparatus to hang folders, comprising:

a first end frame;

a second end frame;

a first rail coupled to the first end frame for hanging a plurality of folders on the first rail, the first rail to receive a portion of a folder supported between the first rail and a second rail coupled to the first end frame, wherein the first end frame is moveable between an expanded position and a contracted position to change a distance between the first and second rails associated with a width of the folder, the plurality of the folders to hang parallel to the first end frame and the second end frame;

the first end frame including:

a first portion to receive the first rail;

a second portion to receive the second rail;

a track interposed between the first portion and the second portion, the track including a first wall, a second wall, and an intermediate surface between the first wall and the second wall, the track to support at least a portion of the first portion and at least a portion of the second portion, the first portion and the second portion slidably coupled to the track to define the expanded position and the contracted position; and a receptacle; and a clip interposed between the first end frame and the first rail to fix an orientation of the first rail relative to the second rail, wherein the first rail includes a curved portion coupled to the clip and a straight portion extending away from the clip.

* * * * *